US012486608B2

(12) United States Patent
Choi et al.

(10) Patent No.: US 12,486,608 B2
(45) Date of Patent: Dec. 2, 2025

(54) WASHING MACHINE AND METHOD OF CONTROLLING THE SAME

(71) Applicant: SAMSUNG ELECTRONICS CO., LTD., Suwon-si (KR)

(72) Inventors: Seunghun Choi, Suwon-si (KR); Jeongnam Kim, Suwon-si (KR); Wanhee Lee, Suwon-si (KR); Jaepoong Lee, Suwon-si (KR); Kwangmin Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 191 days.

(21) Appl. No.: 18/204,067

(22) Filed: May 31, 2023

(65) Prior Publication Data

US 2024/0026593 A1 Jan. 25, 2024

Related U.S. Application Data

(63) Continuation of application No. PCT/KR2023/005292, filed on Apr. 19, 2023.

(30) Foreign Application Priority Data

Jul. 20, 2022 (KR) ..... 10-2022-0089887
Nov. 24, 2022 (KR) ..... 10-2022-0159662

(51) Int. Cl.
*D06F 39/02* (2006.01)
*D06F 33/43* (2020.01)
(Continued)

(52) U.S. Cl.
CPC ..... *D06F 39/022* (2013.01); *D06F 33/43* (2020.02); *D06F 39/085* (2013.01);
(Continued)

(58) Field of Classification Search
CPC ..... D06F 39/02; D06F 39/022; D06F 39/028; D06F 39/085; D06F 33/43;
(Continued)

(56) References Cited

U.S. PATENT DOCUMENTS 10,526,738 B2 1/2020 Cho et al.
11,066,776 B2 7/2021 Ko et al.
(Continued)

FOREIGN PATENT DOCUMENTS

CN 110965278 B 2/2022
CN 114197170 A 3/2022
(Continued)

OTHER PUBLICATIONS

International Search Report dated Aug. 1, 2023 issued in PCT Application No. PCT/KR2023/005292.
(Continued)

*Primary Examiner* — David G Cormier
(74) *Attorney, Agent, or Firm* — STAAS & HALSEY LLP

(57) ABSTRACT

A washing machine including a tub, a drum configured to be rotatable inside the tub, a detergent supply device configured to supply a detergent into the tub, the detergent supply device including a storage area, a pump motor configured to pump a liquid in the storage area, and a discharge port configured to guide the liquid pumped by the pump motor into the tub; a user interface configured to receive a user input to request a cleaning of the storage area, and a controller configured to detect a cleaning condition of the storage area based on a load of the pump motor, and based on the user input being received, perform a cleaning process of the storage area.

18 Claims, 16 Drawing Sheets

(51) Int. Cl.

| | |
|---|---|
| ***D06F 39/08*** | (2006.01) |
| *D06F 103/02* | (2020.01) |
| *D06F 103/42* | (2020.01) |
| *D06F 105/58* | (2020.01) |

(52) U.S. Cl.
CPC ..... *D06F 2103/02* (2020.02); *D06F 2103/42* (2020.02); *D06F 2105/58* (2020.02)

(58) Field of Classification Search
CPC ..... D06F 2103/42; D06F 2103/48; D06F 2105/42; D06F 2105/54; D06F 2105/58
See application file for complete search history.

(56) References Cited

U.S. PATENT DOCUMENTS

| | | | | |
|---|---|---|---|---|
| 11,560,659 | B2 | 1/2023 | Chae et al. | |
| 11,661,697 | B2 | 5/2023 | Kim et al. | |
| 2017/0159221 | A1* | 6/2017 | Cho | D06F 33/43 |
| 2019/0345660 | A1 | 11/2019 | Nam et al. | |
| 2020/0308754 | A1 | 10/2020 | Je et al. | |
| 2021/0301445 | A1 | 9/2021 | Jung et al. | |
| 2024/0426037 | A1* | 12/2024 | Yun | D06F 33/37 |

FOREIGN PATENT DOCUMENTS

| | | |
|---|---|---|
| CN | 114541103 A | 5/2022 |
| JP | 2021-7636 | 1/2021 |
| JP | 6890264 | 6/2021 |
| KR | 1990-0010124 | 7/1990 |
| KR | 10-0461870 | 12/2004 |
| KR | 10-2007-0088212 | 8/2007 |
| KR | 10-0830488 | 5/2008 |
| KR | 10-1476183 | 12/2014 |
| KR | 10-2015-0006260 | 1/2015 |
| KR | 10-2018-0079969 | 7/2018 |
| KR | 10-2018-0096008 | 8/2018 |
| KR | 10-2020-0011309 | 2/2020 |
| KR | 10-2020-0028095 | 3/2020 |
| KR | 10-2020-0120200 | 10/2020 |
| KR | 10-2233307 | 3/2021 |
| KR | 10-2392143 | 4/2022 |
| WO | WO 2019/044306 A1 | 3/2019 |

OTHER PUBLICATIONS

Written Opinion dated Aug. 1, 2023 issued in PCT Application No. PCT/KR2023/005292.
Supplementary European Search Report dated Apr. 23, 2025 issued in European Application No. EP 23 84 3127.

* cited by examiner

WASHING MACHINE AND METHOD OF CONTROLLING THE SAME

CROSS-REFERENCE TO RELATED APPLICATIONS

This application is a continuation application, filed under 35 U.S.C. § 111(a), of International Application PCT/KR2023/005292 filed Apr. 19, 2023, and is based on and claims priority under 35 U.S.C. § 119 to Korean Patent Applications No. 10-2022-0089887, filed on Jul. 20, 2022, and No. 10-2022-0159662, filed on Nov. 24, 2022, in the Korean Intellectual Property Office. The disclosures of which are incorporated by reference herein in its their entireties.

BACKGROUND

Field

The disclosure relates to a washing machine including a detergent supply device and a method of controlling the same.

Description of the Related Arts

In general, a washing machine may include a tub and a drum rotatably installed in the tub, and wash laundry by rotating the drum containing laundry inside the tub. The washing machine may perform a wash process of washing laundry, a rinse process of rinsing washed laundry, and a spin-dry process of spin-drying laundry.

A detergent supply device is a device that allows a detergent (a softener) to be evenly mixed with water supplied to the inside of the tub of the washing machine and then supplied together with the water. When the detergent is a liquid detergent (or a liquid softener), the liquid detergent or liquid softener may be supplied directly into the tub.

The detergent supply device may include an accommodating box for accommodating a detergent (a softener) and a pump motor for pumping the detergent (the softener) contained in the accommodating box.

On the other hand, the detergent accommodated in the accommodating box may be solidified in a predetermined environment, and thus needs cleaning.

SUMMARY

A washing machine including: a tub; a drum configured to be rotatable inside the tub; a detergent supply device configured to supply a detergent into the tub, the detergent supply device including a storage area, a pump motor configured to pump a liquid in the storage area, and a discharge port configured to guide the liquid pumped by the pump motor into the tub; a user interface configured to receive a user input to request a cleaning of the storage area; and a controller configured to detect a cleaning condition of the storage area based on a load of the pump motor, and based on the user input being received, perform a cleaning process of the storage area.

The controller may be configured to, based on the detecting of the cleaning condition of the storage area, control the user interface to notify a user that the storage area needs to be cleaned.

The controller may be configured to drive the pump motor during a wash process or a rinse process, and detect the cleaning condition of the storage area based on a driving voltage value of the pump motor during the wash process or the rinse process.

The controller may be configured to, in response to the driving voltage value of the pump motor being greater than or equal to a predetermined value, detect the cleaning condition of the storage area.

The storage area may include a first storage area and a second storage area, the pump motor may include a first pump motor configured to pump a liquid accommodated in the first storage area and a second pump motor configured to pump a liquid accommodated in the second storage area, and the controller may be configured to drive the first pump motor during the wash process and drive the second pump motor during the rinse process.

The controller may be configured to, in response to a driving voltage value of the first pump motor being greater than or equal to a predetermined value, detect a cleaning condition of the first storage area; and in response to a driving voltage value of the second pump motor being greater than or equal to a predetermined value, detect a cleaning condition of the second storage area.

The washing machine may further include a sensor configured to detect the liquid accommodated in the storage area, wherein based on the detecting of the cleaning condition of the storage area, the controller may be configured to, control the user interface to guide a user to input the user input in response to the liquid not being detected by the sensor.

The washing machine may further include: a water supply device configured to supply external water into the tub; a driving device configured to rotate the drum; and a drain device configured to drain water in the tub, wherein the controller may be configured to control the pump motor, the water supply device, the driving device, and the drain device to perform the cleaning process of the storage area.

The process for cleaning the storage area may include a pump process to drive the pump motor; a water supply process to drive the water supply device; an agitation process to agitate the drum; a drain process to drive the drain device; and a dehydrate process to rotate the drum while driving the drain device.

The washing machine may further include a sensor configured to detect a liquid accommodated in the storage area, wherein the controller may be configured to, in response to a start of the cleaning process to clean the storage area, start the pump process, and based on the liquid not being detected by the sensor, end the pump process.

The controller may be configured to perform each of the water supply process and the agitation process at least once before an ending of the pump process but after the start of the cleaning process of the storage area.

The controller may be configured to, in response to the ending of the pump process, perform each of the water supply process, the drain process, and the spin-dry process at least once.

The storage area may include a first storage area and a second storage area, the pump motor may include a first pump motor configured to pump a liquid accommodated in the first storage area and a second pump motor configured to pump a liquid accommodated in the second storage area, the cleaning process of the storage area may include a first cleaning process to clean the first storage area, a second cleaning process to clean the second storage area, and a third cleaning process to clean both the first storage area and the second storage area, and the pump process may include a first pump process to drive the first pump motor, a second pump process to drive the second pump motor, and a third pump process to drive at least one of the first pump motor and the second pump motor.

The storage area may include a first storage area and a second storage area, the user interface may be configured to: provide a first user interface to set a use of the second storage area as a detergent compartment or a softener compartment; and provide a second user interface to request a cleaning of the second storage area in response to the use of the second storage area being changed through the first user interface.

The controller may be configured to, upon receiving a user input to request the cleaning of the second storage area through the second user interface, perform a cleaning process to clean the second storage area.

The controller may control the user interface to notify the user by displaying a message indicating that the storage area needs to be cleaned.

The controller may control the user interface to notify the user by sounding a warning sound or read a text message indicating that the storage area needs to be cleaned.

The controller may be configured to the user interface to transmit a message to an external device to notify that the storage area needs to be cleaned.

According to an aspect, there is provided a method of controlling a washing machine including a detergent supply device including a storage area, a pump motor configured to pump a liquid accommodated in the storage area, and a discharge port configured to guide the liquid pumped by the pump motor into the tub, the method including: detecting a cleaning condition of the storage area based on a load of the pump motor; and upon receiving a user input to request cleaning of the accommodating potion, performing a process for cleaning the storage area.

The method may further include, based on detecting the cleaning condition of the storage area, providing an indicator for notifying that the storage area needs cleaning.

The detecting of the cleaning condition of the storage area based on the load of the pump motor may include: driving the pump motor during a wash process or a rinse process; and detecting the cleaning condition of the storage area based on a driving voltage value of the pump motor.

The detecting of the cleaning condition of the storage area based on the driving voltage value of the pump motor may include, in response to the driving voltage value of the pump motor being greater than or equal to a predetermined value, detecting the cleaning condition of the storage area.

The method may further include, based on detecting an absence of the liquid by a sensor configured to detect a liquid accommodated in the storage area and the cleaning condition of the storage area, providing an indicator for inducing the user input.

DETAILED DESCRIPTION

Figure 1:
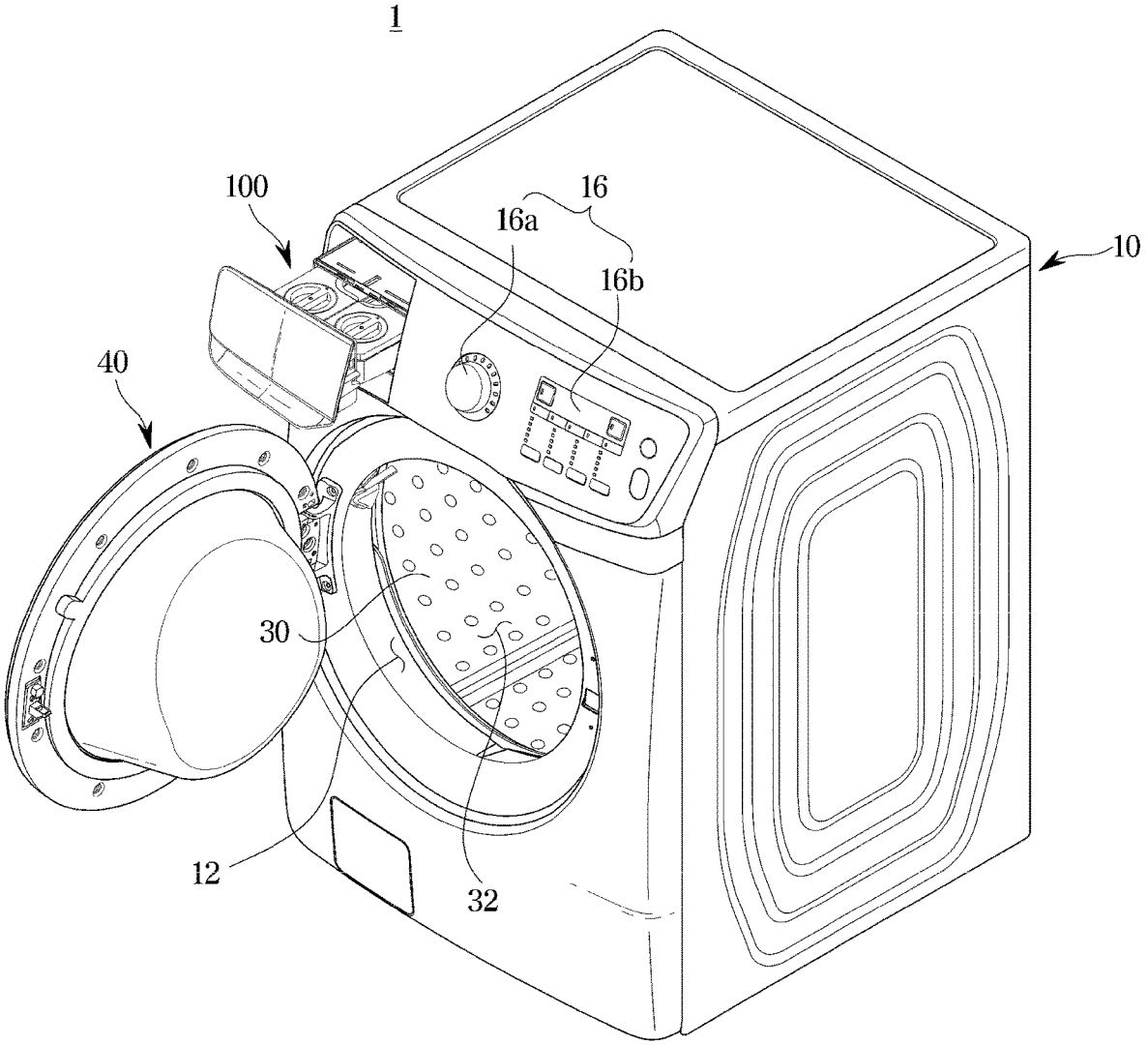
FIG. 1 is a view illustrating an external appearance of a washing machine according to an embodiment.

The embodiments described in the present specification and the configurations shown in the drawings are only examples of preferred embodiments of the disclosure, and various modifications may be made at the time of filing of the disclosure to replace the embodiments and drawings of the present specification.

The terms used herein are for the purpose of describing the embodiments and are not intended to restrict and/or to limit the disclosure.

For example, the singular expressions herein may include plural expressions, unless the context clearly dictates otherwise.

Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

The terms, such as "~part", "~device", "~block", "~member", "~module", and the like may refer to a unit for processing at least one function or act. For example, the terms may refer to at least process processed by at least one hardware, such as field-programmable gate array (FPGA)/application specific integrated circuit (ASIC), software stored in memories, or processors.

Hereinafter, an embodiment of the disclosed invention will be described in detail with reference to the accompanying drawings. The same reference numbers or symbols presented in the accompanying drawings may indicate parts or components that perform substantially the same function.

Hereinafter, the operating principles and embodiments of the disclosure will be described with reference to the accompanying drawings.

The disclosure provides a washing machine and a method of controlling the same that are capable of inducing cleaning of a storage area of a detergent supply device by notifying a user that the storage area needs cleaning.

According to one aspect of the disclosure, a user can easily recognize whether cleaning of a detergent supply device is needed.

In addition, according to one aspect of the disclosure, a storage area having been used as a detergent compartment can be used as a softener compartment.

In addition, according to one aspect of the disclosure, when an accommodating compartment having been used as a detergent compartment is used as a softener box, solidification of detergent due to a combination of a detergent remaining in the accommodating compartment and newly introduced softener can be prevented. FIG. 1 is a view illustrating an external appearance of a washing machine according to an embodiment, and FIG. 2 is a side cross-sectional view of a washing machine according to an embodiment.

Figure 2:
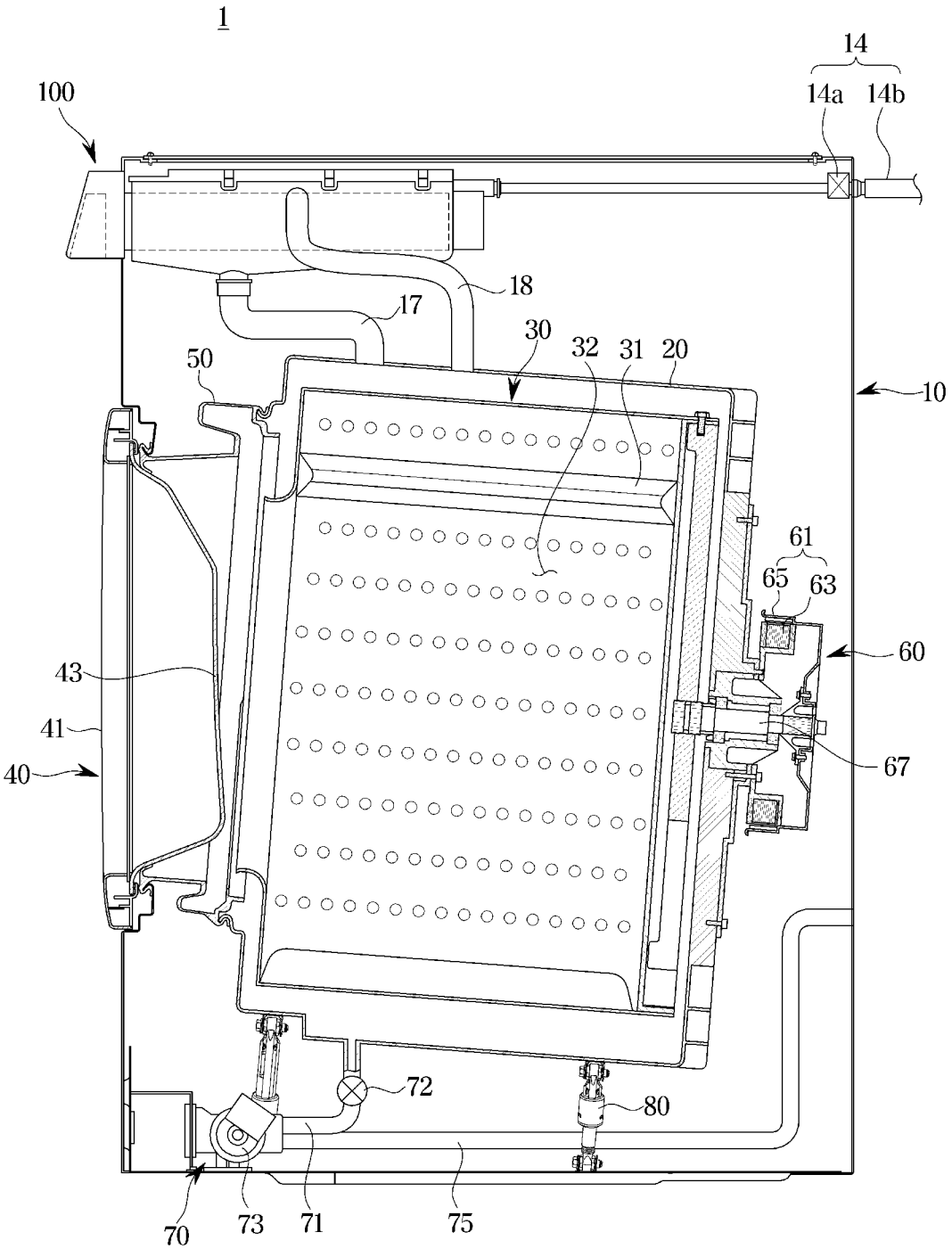
FIG. 2 is a side cross-sectional view of a washing machine according to an embodiment.

Referring to FIGS. 1 and 2, the configuration of the washing machine 1 is described.

A washing machine 1 according to an embodiment may be a drum-type washing machine that rotates a drum 30 and causes laundry to repeat rising and falling to wash the laundry and a motor-operated washing machine that uses a water current generated by a pulsator when the drum 30 rotates to wash laundry.

The washing machine 1 may also be classified according to a direction in which laundry is put into the drum 30. The washing machine 1 may be classified into a front-loading type washing machine in which laundry is put into the drum 30 from the front and a top-loading type washing machine in which laundry is put into the drum 30 from above.

That is, the washing machine 1 according to the disclosure may be a drum type washing machine or a motor-operated washing machine, and a method of controlling the washing machine 1 according to the disclosure may be applied to both the drum type washing machine and the motor-operated washing machine. However, in the following description, a case in which the washing machine 1 according to an embodiment is a drum type washing machine is given as an example.

A washing machine according to various embodiments may perform wash, rinse, drain, and spin-dry processes. The washing machine may be a washer-dryer combo capable of performing a dry process on laundry that is dehydrated.

A washing machine may be an example of a laundry treatment device. The laundry treatment device is a concept including a device for washing clothes (objects to be washed and objects to be dried), a device for drying clothes, and a device capable of both washing and drying clothes. The washer-drier combo may include a heat pump to dry laundry stored in the drum. A washing machine according to various embodiments may include a washing machine using a washing method other than the above-described washing method.

Referring to FIG. 1, the washing machine 1 may include a cabinet 10 that forms the external appearance thereof and accommodates various components therein. The cabinet 10 may be formed in a substantially hexahedral shape.

The cabinet 10 may include a user interface device 16 formed on a front surface thereof and including an input interface 16*a* for receiving operation commands from a user and an output interface 16*b* for displaying operation information of the washing machine 1. However, the location of the user interface device 16 is not limited to the front surface of the cabinet 10.

The cabinet 10 has an opening formed in a front surface thereof, through which laundry may be input into the drum 30. The opening formed in the front surface of the cabinet 10 may be opened or closed by a door 40. The door may be rotatably mounted on the front surface of the cabinet 10 by a hinge member.

A space inside the drum 30 may be defined as a washing chamber 32. After putting laundry into the washing chamber 32 and closing the door 40, the user may start washing the laundry.

The washing machine 1 may include a detergent supply device 100. The detergent supply device 100 is a device that allows a detergent to be supplied into a tub 20 of the washing machine 1. Although the detergent supply device 100 is illustrated in FIG. 1 as being provided on an upper left side of the washing machine 1, this is only an example, and the disclosure is not limited thereto.

A detailed configuration of the detergent supply device 100 and the washing machine 1 including the same will be further described below.

As illustrated in FIG. 2, the cabinet 10 forming the external appearance of the washing machine 1 may include a tub 20 provided to store mixed water in which water and detergent are mixed. Inside the tub 20, a drum 30 forming the washing chamber 32 to accommodate laundry may be provided. In other words, the drum 30 may be provided inside the cabinet 10 and form the washing chamber 32 therein.

An opening may be formed in each of the tub 20 and the drum 30 to allow laundry to be put in or taken out through the front of the cabinet 10, and the openings of the tub 20 and the drum 30 may be positioned to correspond to the opening in the front surface of the cabinet 10.

The opening provided in the front surface of the cabinet 10 may be opened or closed by the door 40. The door 40 may include a door frame 41 and a door glass 42. The door glass 42 may be formed of a transparent tempered glass material so that an inside of the cabinet 10 is transparent.

A water supply device 14 including a water supply pipe 14*a* and a water supply valve 14*b* opening and closing the water supply pipe 14*a* may be provided on an upper side of the tub 20. In addition, the detergent supply device 100 configured to supply a detergent into the tub 20 in a process of supplying water may be installed on an upper front side of the tub 20.

The detergent supply device 100 may be connected to the tub 20 through a detergent supply pipe 17. Water supplied through the water supply pipe 14*a* may be mixed with detergent via the detergent supply device 100, and the mixed water in which the water and the detergent are mixed may be supplied into the tub 20. In the case of liquid detergent, the water supply pipe 14*a* may directly supply water into the tub 20 through a separate control valve (not shown), and liquid detergent may be supplied into the tub 20 through the detergent supply pipe 17 via the detergent supply device 100.

The detergent supply device 100 may be connected to the tub 20 through an air pipe 18. The air pipe 18 may be provided to allow air to flow into and/or flow out of the detergent supply device 100. Accordingly, the air pipe 18 may prevent a decrease in pressure inside the detergent supply device 100.

A driving device 60 may be disposed behind the drum 30. The driving device 60 is a configuration for rotating the drum 30 and may include a drive motor 61, a driving circuit for driving the drive motor 61, and other components A driving force generated from the drive motor 61 may be provided to be transmitted to a rotating shaft 67 to rotate the drum 30.

The drive motor 61 may include a stator 63 and a rotor 65 which electromagnetically interacts with the stator 63 to rotate, and may convert electric force into mechanical force and rotational force.

The tub 20 may store the mixed water in which the water and the detergent are mixed and may be formed in a substantially cylindrical shape. The tub 20 may be fixed inside the cabinet 10. The tub 20 may be connected to the opening formed in the front surface of the cabinet 10 by a diaphragm 50.

A spray nozzle (not shown) connected to a circulation hose (not shown) and configured to spray the mixed water circulating therein into the drum 30 may be provided on one side of the diaphragm 50. The spray nozzle 70 may be provided to spray the mixed water evenly throughout the laundry accommodated in the drum 30. The circulation hose may be connected to a circulation pump configured to pump the stored mixed water from a lower portion of the tub 20.

The drum 30 may rotate inside the tub 20 and cause laundry to rise and fall to wash the laundry. A plurality of lifters 31 may be provided inside the drum 30.

A drain device 70 including drain pipes 71 and 75 for draining water inside the tub 20, a drain valve 72 opening and closing the drain pipe 71, a drain pump 73 pumping water of the drain pipe 71 to the outside of the cabinet 10 through the drain pipe 75, and the like may be installed on the lower side of the tub 20.

The tub 20 may be provided to be elastically supported in the cabinet 10 by a spring (not shown) at an upper portion and dampers 80 at a lower portion. That is, the spring and the dampers 80 may be provided to, while vibration generated during rotation of the drum 30 is transmitted to the tub 20 and the cabinet 10, absorb vibrational energy and attenuate vibration between the tub 20 and the cabinet 10.

Hereinafter, the configuration of the detergent supply device 100 will be described in more detail.

Figure 3:
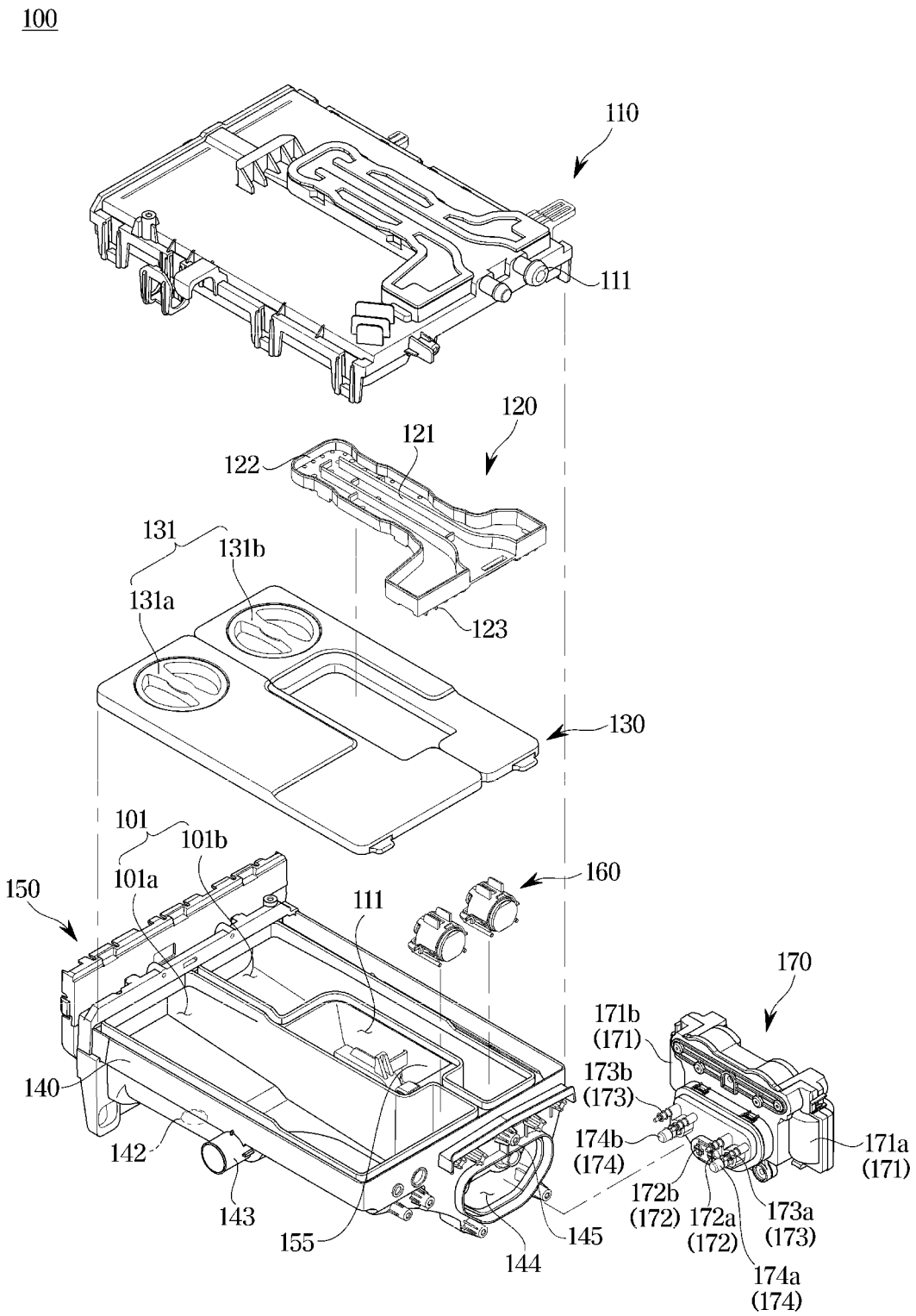
FIG. 3 is an exploded view of a rear of a detergent supply device shown in FIG. 2.

FIG. 3 is an exploded view of a rear of a detergent supply device shown in FIG. 2.

As illustrated in FIG. 3, the detergent supply device 100 may include a cover 110. The cover 110 may form an exterior of the detergent supply device 100 together with a housing 140. The cover 110 may be coupled to an upper portion of a water supply plate 120 to seal the water supply plate 120. In other words, the cover 110 may be coupled to the water supply plate 120 to form a flow path along which wash water supplied from the water supply device 14 moves.

The cover 110 may include a water supply chamber (or a wash water inlet) 111 connected to the water supply device 14. Wash water may flow into the detergent supply device 100 through the water supply chamber 111.

The detergent supply device 100 may further include the water supply plate 120 coupled to the cover 110 and disposed between the cover 110 and the housing 140. The water supply plate 120 may include a guide partition 121 configured to partition a flow path to allow wash water to flow therein. Together with the cover 110, the water supply plate 120 may form the flow path along which the wash water supplied from the water supply device 14 moves.

The water supply plate 120 may include a wash water movement hole 122 provided to allow wash water, which is supplied from the water supply device 14 to a space between the cover 110 and the water supply plate 120, to be discharged to the water supply chamber 111. The wash water movement hole 122 may be formed to pass through the water supply plate 120. The wash water movement hole 122 may be formed in one area of the water supply plate 120 to correspond to the water supply chamber 111. In other words, the wash water movement hole 122 may be formed in one area of the water supply plate 120 that faces the water supply chamber 111.

In order to prevent a detergent, which is discharged to a mixing chamber 144 by a detergent discharge portion 172 of a detergent pump 170, from remaining in the mixing chamber 144, the water supply plate 120 may include a through-hole 123 provided to allow passage of a portion of the wash water supplied from the water supply device 14. The through-hole 123 may be disposed upstream of the wash water movement hole 122 in a direction in which the wash water supplied from the water supply device 14 moves. In other words, the through-hole 123 may be formed in the water supply plate 120 so as to be adjacent to the water supply chamber 111. A portion of the wash water supplied from the water supply device 14 may be discharged to the water supply chamber 111 through the wash water movement hole 122, and the rest of the wash water may be discharged to the mixing chamber 144 through the through-hole 123. The mixed water discharged into the mixing chamber 144 may be discharged into the tub 20 through an outlet 142.

The detergent supply device 100 may further include the housing 140 configured to form the exterior of the detergent supply device 100 together with the cover 110. The housing 140 may be coupled to a detergent container 150, in which a storage area 101 is formed to accommodate a detergent, such that withdrawal of the detergent container 150 is allowed. The storage area 101 may include a plurality of storage areas 101*a* and 101*b*.

The housing 140 may be formed in a lower portion with the outlet 142 that allows at least one of wash water or detergent to be discharged to the outside of the detergent supply device 100. The outlet 142 is connected to a detergent supply pipe (17 in FIG. 2), and at least one of wash water or detergent discharged through the outlet 142 moves into the tub 20 via the detergent supply pipe (17 in FIG. 2). The lower portion of the housing 140 is formed to be inclined toward the outlet 142 to allow at least one of wash water or detergent to be smoothly discharged through the outlet 142 without accumulating on the lower portion of the housing 140.

The housing 140 may be formed at one side with an air portion 143 that allows air to flow therethrough to thereby adjust the pressure inside the housing 140. The air portion 143 may be connected to the air pipe (18 in FIG. 2).

The detergent supply device 100 may include the detergent container 150 including the storage area 101 in which detergent may be accommodated.

Although the detergent container 150 is illustrated in FIG. 3 as one body, the detergent container 150 may include a compartment (not shown) configured to form the storage area 101, in which detergent may be accommodated, and an inner housing (not shown) configured to accommodate the compartment.

The storage area 101 may include a first storage area 101*a* and a second storage area 101*b*. The first storage area 101*a* and the second storage area 101*b* may be separated by housings independent of each other.

The detergent container 150 may be movably mounted on the housing 140. A liquid detergent may be accommodated in each of the first storage area 101*a* and the second storage area 101*b*. Examples of the liquid detergent may include a detergent, a rinse, a fabric softener, and the like.

A detergent container cover 130 may be provided above the detergent container 150 to cover the detergent container 150. The detergent container cover 130 may be formed to correspond to the shape of an upper side of the detergent container 150. However, at a position that corresponds to the wash water movement hole 122 of the water supply plate 120, the detergent container cover 130 may not be formed to allow movement of wash water.

A detergent container cap 131 may be provided in front of the detergent container cover 130 to allow a detergent to be added into the storage area 101. The detergent container cap 131 may be detachably coupled to the detergent container cover 130.

The detergent container cap 131 may include a first cap 131*a* detachable from the detergent container cover 130 to allow a detergent to be added into the first storage area 101*a*, and a second cap 131*b* detachable from the detergent container cover 130 to allow a detergent to be added into the second storage area 101*b*.

The detergent supply device 100 may further include the water supply chamber 111 formed in the detergent container 150 to allow an inflow of wash water which has passed through the wash water movement hole 122. The water supply chamber 111 may be defined by a water supply chamber frame 155 of the detergent container 150. The wash water passed through the wash water movement hole 122 may directly flow into the water supply chamber 111. Wash water supplied between the cover 110 and the water supply plate 120 may easily pass through the wash water movement hole 122 due to gravity and flow into the water supply chamber 111.

A powder detergent may be added into the water supply chamber 111 in some cases. In a case in which a powder detergent is added into the water supply chamber 111, the powder detergent may flow into the mixing chamber 144 together with wash water introduced through the wash water movement hole 122. A communication hole (not shown) may be formed in a lower side of the water supply chamber 111. The water supply chamber 111 and the mixing chamber 144 may be provided to communicate with each other.

The detergent supply device 100 may further include the mixing chamber 144 provided to allow at least one of wash water discharged from the water supply chamber 111 or detergent discharged from the detergent container 150 to pass and be supplied to the tub 20. The mixing chamber 144 may be formed between the detergent container 150 and the housing 140.

The detergent supply device 100 may include the detergent pump 170 provided to suction detergent from the detergent container 150 and discharge the suctioned detergent to the mixing chamber 144.

The detergent pump 170 may include a shape corresponding to a support protrusion 145 formed at the rear of the housing 140.

The detergent pump 170 may include a pump motor 171 that provides a suction force for suctioning the detergent accommodated in the storage area 101, a detergent intake portion 174 that guides the detergent stored in the storage area 101 to the inside of the detergent pump 170, a detergent discharge portion 172 that discharges the detergent guided to the inside of the detergent pump 170 into the mixing chamber 144, and a detergent detecting sensor 173 that detects liquid accommodated in the storage area 101.

The detergent intake portion 174 may include intake ports 174*a* and 174*b* communicating with the storage area 101.

In an embodiment, the detergent intake portion 174 may include at least one of a first intake portion 174*a* communicating with the first storage area 101*a* or a second intake portion 174*b* communicating with the second storage area 101*b*.

The detergent intake portion 174 may pressurize a detergent compartment valve 160 to adjust inflow of detergent into the detergent pump 170.

The pump motor 171 may include at least one of a first pump motor 171*a* providing suction power to a space formed inside of the first intake port 174*a* or a second pump motor 171*b* providing suction power to a space formed inside of the second intake port 174*b*.

The detergent discharge portion 172 may include at least one of a first discharge port 172*a* for guiding liquid suctioned from the first storage area 101*a* through the first intake port 174*a* to the mixing chamber 144 or a second discharge port 172*b* for guiding liquid suctioned from the second storage area 101*b* through the second intake port 174*b* to the mixing chamber 144.

The detergent detecting sensor 173 may include at least one of a first sensor 173*a* for detecting liquid accommodated in the first storage area 101*a* or a second sensor 173*b* for detecting liquid accommodated in the second storage area 101*b*.

Each of the first sensor 173*a* and the second sensor 173*b* may include an electrode sensor composed of a pair of electrodes.

Detergent is an electrolyte that conducts electricity, and current may flow between a pair of electrodes in contact with the detergent. By current flowing between the pair of electrodes when a current is applied to one of the pair of electrodes, the presence of liquid in the storage area 101 may be detected.

However, the detergent detecting sensor 173 is not limited to the electrode sensor, and any configuration capable of detecting a liquid accommodated in the storage area 101 may be employed as the configuration of the detergent detecting sensor 173 without limitation.

When the pump motor 171 operates, the liquid accommodated in the storage area 101 may be introduced into the detergent pump 170 through the detergent intake portion 174, and the liquid introduced into the detergent pump 170 may be discharged into the mixing chamber 144 through the detergent discharge portion 172, and the liquid discharged to the mixing chamber 144 may be introduced into the tub 20 through the outlet 142.

In an embodiment, when the first pump motor 171*a* operates, the liquid accommodated in the first storage area 101*a* may be introduced into the detergent pump 170 through the first intake port 174*a*, and the liquid introduced into the detergent pump 170 may be discharged into the mixing chamber 144 through the first discharge port 172*a*, and the liquid discharged to the mixing chamber 144 may be introduced into the tub 20 through the outlet 142.

In an embodiment, when the second pump motor 171*b* operates, the liquid accommodated in the second storage area 101*b* may be introduced into the detergent pump 170 through the second intake port 174*b*, and the liquid introduced into the detergent pump 170 may be discharged into the mixing chamber 144 through the second discharge port 172*b*, and the liquid discharged to the mixing chamber 144 may be introduced into the tub 20 through the outlet 142.

The liquid to be introduced into the tub 20 may be mixed with wash water supplied to the water supply chamber 111, and thus discharged through the outlet 142.

Although not shown in FIG. 3, according to various embodiments, the detergent supply device 100 may further include a water supply pipe (not shown) connected to the water supply device 14 and supplying water to the storage area 101 and a valve (not shown) opening and closing the water supply pipe (not shown). As will be described below, when the detergent supply device 100 includes a configuration capable of supplying water to the storage area 101, a cleaning process of the storage area may be started only by a user's command without user intervention.

Figure 4:
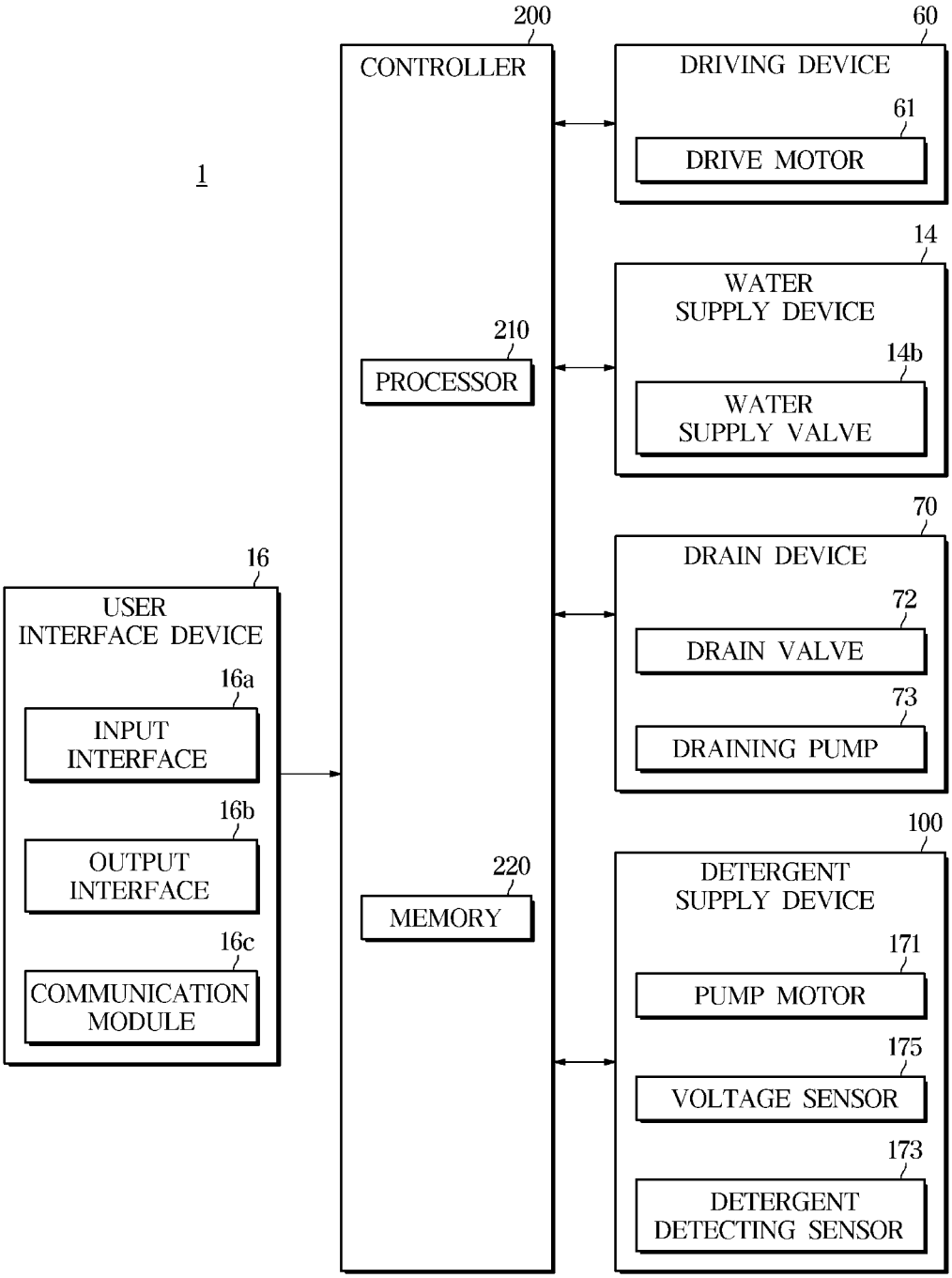
FIG. 4 is a control block diagram illustrating a washing machine according to an embodiment.

FIG. 4 is a control block diagram illustrating a washing machine according to an embodiment.

The washing machine 1 may further include electrical/electronic components described below as well as the components described with reference to FIGS. 1 to 3.

Referring to FIG. 4, the washing machine 1 according to an embodiment includes a user interface device (user interface) 16, a driving device 60, a water supply device 14, a drain device 70, a detergent supply device 100, and a controller 200.

For example, the user interface device 16 may include a control panel.

The user interface device 16 may provide a user interface for interaction between the user and the washing machine 1.

The user interface device 16 may include at least one input interface 16*a* and at least one output interface 16*b*.

The at least one input interface 16*a* may convert sensory information received from a user into an electrical signal.

The at least one input interface 16*a* may include a power button, an operation button, a course selection dial (or course selection button), and wash/rinse/spin-dry setting buttons. The at least one input interface 16*a* may include, for example, a tact switch, a push switch, a slide switch, a toggle switch, a micro switch, a touch switch, a touch pad, a touch screen, a jog dial, and/or a microphone, etc.

The at least one output interface 16*b* may generate sensory information, thereby transmitting various data related to the operation of the washing machine 1 to the user.

For example, the at least one output interface 16*b* may transmit information related to a wash course, an operating time of the washing machine 1, and wash setting and/or rinse setting and/or spin-dry setting to the user. Information about the operation of the washing machine 1 may be output through a sensory indicator, such as a screen or a speech. The at least one output interface 16*b* may include, for example, a liquid crystal display (LCD) panel, a light emitting diode (LED) panel, or a speaker.

According to various embodiments, the user interface device 16 may include a communication module 16*c* for wired and/or wireless communication with an external device.

The communication module 16*c* may include at least one of a short-range communication module or a long-range communication module.

The communication module 16*c* may transmit data to an external device (e.g., a server, a user device, and/or a home appliance) or receive data from the external device. For example, the communication module 16*c* may establish communication with a server (2, in FIG. 8) and/or a user device (3, in FIG. 8) and/or home appliances, and transmit and receive various types of data.

To this end, the communication module 16*c* may support establishment of a direct (e.g., wired) communication channel or wireless communication channel between the communication module 16*c* and external devices, and support communication through the established communication channel. According to an embodiment, the communication module 16*c* may include a wireless communication module (e.g., a cellular communication module, a short-range wireless communication module, or a global navigation satellite system (GNSS) communication module) or a wired communication module (e.g., a local area network (LAN) communication module, or a power line communication module). Among the communication modules, the corresponding communication module may communicate with an external device through a first network (e.g., a short-range communication network such as Bluetooth, wireless fidelity (WiFi) direct, or infrared data association (IrDA)) or a second network (e.g., a long-range communications network such as a legacy cellular network, a 5G network, a next-generation communication network, the Internet, or a computer network (e.g., LAN or WAN)). These various types of communication modules may be integrated as one component (e.g., a single chip) or implemented as a plurality of separate components (e.g., a plurality of chips).

The short-range wireless communication module may include a Bluetooth communication module, a Bluetooth Low Energy (BLE) communication module, a near field communication module, a WLAN (Wi-Fi) communication module, a Zigbee communication module, an infrared communication module (IrDA, infrared data association), a Wi-Fi Direct (WFD) communication module, a ultra-wideband (UWB) communication module, an Ant+ communication module, a microwave (uWave) communication module, etc., but is not limited thereto.

The long-range communication module may include a communication module that performs various types of remote communication, and may include a mobile communication part. The mobile communication part transmits and receives radio signals with at least one of a base station, an external terminal, or a server on a mobile communication network.

In an embodiment, the communication module 16*c* may communicate with an external device, such as a server, a user device, or other home appliances, through a nearby access point (AP). The AP may connect a local area network (LAN), to which the washing machine 1 or a user device is connected, to a wide area network (WAN), to which a server is connected. The washing machine 1 or the user device may be connected to the server through a wide area network (WAN).

The driving device 60 may include a drive motor 61 and a rotating shaft 67 for transmitting driving force generated by the drive motor 61 to the drum 30. The rotating shaft 67 may be connected to the drum 30 by passing through the tub 20.

The driving device 60 may be provided to perform a wash operation, a rinse and/or a spin-dry operation, or a dry operation by forward or reverse rotation of the drum 30.

The water supply device 14 may include a water supply pipe 14*a* and a water supply valve 14*b* provided on the water supply pipe 14*a*. The water supply pipe 14*a* may be connected to an external water supply source. The water supply pipe 14*a* may extend from the external water supply source to the detergent supply device 100 and/or the tub 20. Water may be supplied to the tub 20 by passing through the detergent supply device 100. Water may be supplied to the tub 20 without passing through the detergent supply device 100.

The water supply valve 14*b* may open or close the water supply pipe 14*a* in response to an electrical signal from the controller 200. The water supply valve 14*b* may allow or block supply of water from an external water supply source to the tub 20. The water supply valve 14*b* may include, for example, a solenoid valve that opens and closes in response to an electrical signal.

The drain device 70 may be configured to discharge water accommodated in the tub 20 to the outside. The drain device 70 includes drain pipes 71 and 75 extending from the lower portion of the tub 20 to the outside of the cabinet 10, a drain valve 72 provided on the drain pipes 71 and 75 to open and close the drain pipes 71 and 75, and a drain pump 73 provided on the drain pipes 71 and 75. The drain pump 73 may pump water in the tub 20 to the outside of the cabinet 10.

The detergent supply device 100 may be configured to supply detergent into the tub 20 during a process of supplying water. Water supplied through the water supply pipe 14*a* may be mixed with the detergent via the detergent supply device 100. Water mixed with detergent may be supplied into the tub 20. Detergents may include not only laundry detergents but also softeners, dryer rinses, deodorants, disinfectants, or fragrances.

The detergent supply device 100 includes a pump motor 171 for pumping the liquid accommodated in the storage area 101, and discharge ports 172*a* and 172*b* for guiding the liquid pumped by the pump motor 171 into the tub 20.

The detergent supply device 100 may include a detergent detecting sensor 173 for detecting a liquid accommodated in the storage area 101.

The detecting of a liquid accommodated in the storage area 101 may include detecting whether the amount of a liquid accommodated in the storage area 101 is less than a threshold value. However, according to various embodiments, the detecting of a liquid accommodated in the storage area 101 may further include detecting the type of a liquid accommodated in the storage area 101.

For example, when the detergent detecting sensor 173 is implemented as a pair of electrode sensors, whether the amount of a liquid accommodated in the storage area 101 is less than a threshold value may be determined based on the value of the current flowing through the pair of electrode sensors. As another example, the detergent detecting sensor 173 may determine whether the type of a liquid accommodated in the storage area 101 is a detergent or water based on a value of the current flowing through the pair of electrode sensors.

According to various embodiments, the detergent supply device 100 may include at least one sensor for detecting the load of the pump motor 171.

For example, the detergent supply device 100 may include at least one voltage sensor 175 that detects a driving voltage value for driving the pump motor 171.

The voltage sensor 175 may include at least one of a first voltage sensor that detects a driving voltage value for driving the first pump motor 171*a* or a second voltage sensor that detects a driving voltage value for driving the second pump motor 171*b*.

The voltage sensor 175 may be replaced with any other sensor as long as it can detect the load of the pump motor 171 without limitation.

For example, the voltage sensor 175 may include at least one current sensor for detecting a driving current value for driving the pump motor 171.

That is, the detecting of a driving voltage value in the disclosure is to detect the load of the pump motor 171, and may be considered the same as detecting a driving current value.

The controller 200 may control various components of the washing machine 1 (e.g., the user interface device 16, the driving device 60, the water supply device 14, the drain device 70, and the detergent supply device 100). The controller 200 may control the components of the washing machine 1 to perform at least one process including a supply of water, a wash, a rinse, and/or a spin-drying according to a user input. For example, the controller 200 may control the drive motor 61 to adjust the rotation speed of the drum 30 or control the water supply valve 14*b* of the water supply device 14 to supply water to the tub 20.

As another example, the controller 200 may control the detergent supply device 100 to supply detergent to the tub 20 or control the drain device 70 to discharge water in the tub 20 to the outside.

The controller 200 may include hardware, such as a central processing unit (CPU) or a memory, and software, such as a control program. For example, the controller 200 may include at least one memory 220, in which an algorithm for controlling the operation of components in the washing machine 1 and data in the form of a program are stored, and at least one processor 210 that performs the above-described operations and operations to be described below using the data stored in the at least one memory 220. The memory 220 and the processor 210 may be implemented as separate chips. The processor 210 may include one or more processor chips or may include one or more processing cores. The memory 220 may include one or more memory chips or one or more memory blocks. In addition, the memory 220 and the processor 210 may be implemented as a single chip.

Figure 5:
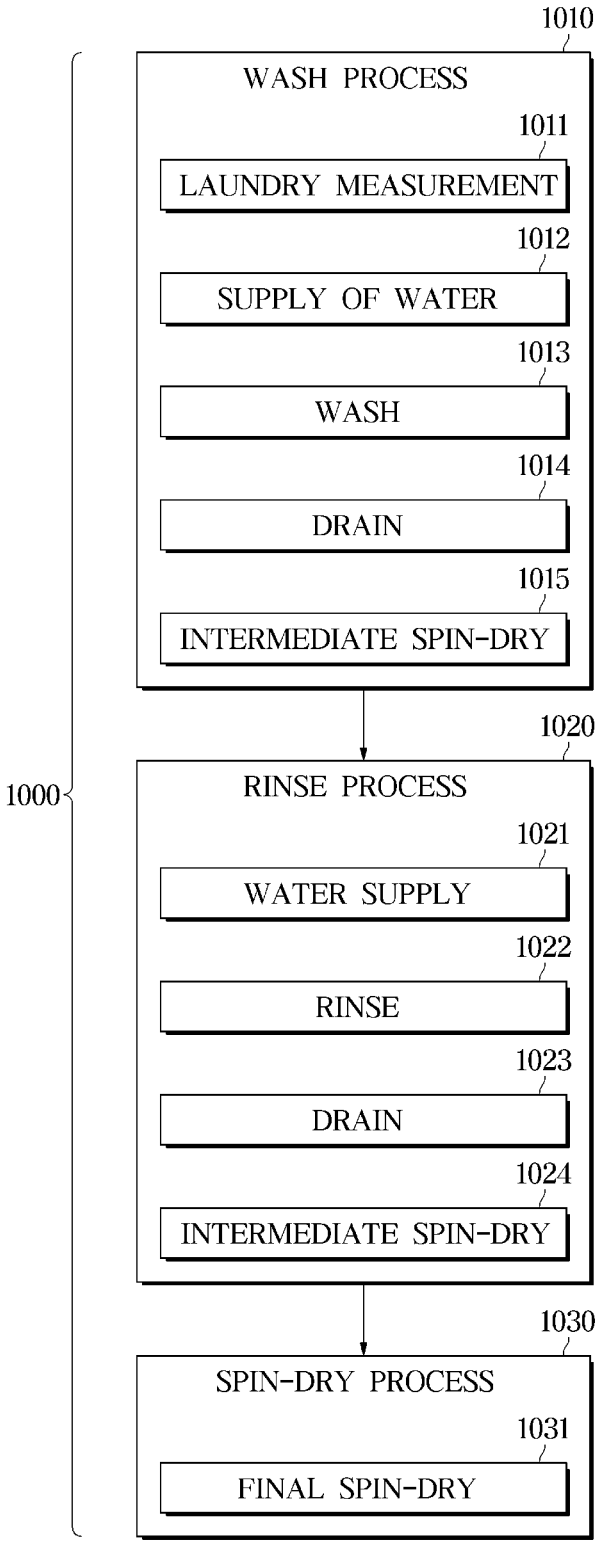
FIG. 5 is a view illustrating an example of a laundry cycle of a washing machine according to an embodiment.

FIG. 5 is a view illustrating an example of a laundry cycle of a washing machine according to an embodiment.

Referring to FIG. 5, in an embodiment, a laundry cycle (1000) of the washing machine 1 may include a wash process (1010), a rinse process (1020), and a spin-dry process (1030).

The washing machine 1 may sequentially perform the wash process (1010), the rinse process (1020), and the spin-dry process (1030) according to a user input through the input interface 16*a*.

By the wash process (1010), laundry may be washed. Specifically, foreign substances attached to the laundry may be separated by a chemical action of detergent and/or a mechanical action, such as falling.

The wash process 1010 may include a laundry measurement (1011) for measuring the amount of laundry, a supply of water (1012) for supplying water to the tub 20, a wash (1013) for washing laundry by rotating the drum 30 at a low speed, a drain (1014) for discharging water accommodated in the tub 20, and an intermediate spin-dry (1015) for separating water from laundry by rotating the drum 30 at high speed.

For the wash 1013, the controller 200 may control the driving device 60 to rotate the drive motor 61 forward or reverse. By the rotation of the drum 30, the laundry falls from the upper side of the drum 30 to the lower side so that the laundry may be washed by the falling.

For the intermediate spin-dry 1015, the controller 200 may control the driving device 60 to rotate the drive motor 61 at high speed. By the high-speed rotation of the drum 30, water may be separated from the laundry accommodated in the drum 30 and thus discharged to the outside of the washing machine 1.

During the intermediate spin-dry 1015, the rotational speed of the drum 30 may increase stepwise. For example, the controller 200 may control the driving device 60 to rotate the drive motor 61 at a first rotational speed, and based on a change in the driving current of the drive motor 61 while the drive motor 61 is rotating at the first rotational speed, control the drive motor 61 to increase the rotational speed of the drive motor 61 to the second rotational speed. The controller 200 may, based on a change in the driving current of the drive motor 61 while the drive motor 61 is rotating at the first rotational speed, control the drive motor 61 to increase the rotational speed of the drive motor 61 to the third rotational speed or control the drive motor 61 to decrease the rotational speed of the drive motor 61 to the second rotational speed.

By the rinse process 1020, the laundry may be rinsed. Specifically, detergents or foreign substances left on the laundry may be washed away with water.

The rinse process 1020 may include a supply of water (1021) for supplying water to the tub 20, a rinse (1022) for rinsing laundry by driving the drum 30, a drain (1023) for discharging water accommodated in the tub 20, and an intermediate spin-dry (1024) for separating water from laundry by driving the drum 30.

The supply of water 1021, the drain 1023, and the intermediate spin-dry 1024 of the rinse process 1020 may be the same as the supply of water 1012), the drain 1014, and the intermediate spin-dry 1015 of the wash process 1010, respectively. During the rinse process 1020, the supply of water 1021, the rinse 1022, the drain 1023, and the intermediate spin-dry 1024 may be performed once or several times.

By the spin-dry process 1030, laundry may be dehydrated. Specifically, water may be separated from the laundry by a high-speed rotation of the drum 30, and the separated water may be discharged to the outside of the washing machine 1.

The spin-dry process 1030 may include a final spin-dry (1031) in which the drum 30 is rotated at high speed to separate water from the laundry. Due to the final spin-dry 1031, the last intermediate spin-dry 1024 of the rinse process 1020 may be omitted.

For the final spin-dry 1031, the controller 200 may control the driving device 60 to rotate the drive motor 61 at high speed. By the high-speed rotation of the drum 30, water may be separated from the laundry accommodated in the drum 30 and discharged to the outside of the washing machine 1. In addition, the rotational speed of the drive motor 61 may increase in a stepwise manner.

Since the operation of the washing machine 1 ends with the final spin-dry 1031, the operation time of the final spin-dry 1031 may take longer than the operation time of the intermediate spin-dry (1015 or 1024).

According to various embodiments, in the water supply operation 1012 during the wash process 1010, detergent accommodated in the detergent supply device 100 may be supplied to the tub 20.

The controller 200 may, in the water supply operation 1012 during the wash process 1010, drive the pump motor 171 such that the detergent accommodated in the storage area 101 may be supplied to the tub 20.

For example, the controller 200 may drive the first pump motor 171*a* such that the detergent accommodated in the first storage area 101*a* may be supplied to the tub 20.

According to various embodiments, in the water supply operation 1021 during the rinse process 1020, the detergent (softener) accommodated in the detergent supply device 100 may be supplied to the tub 20.

The controller 200 may, in the water supply operation 1021 during the rinse process 1020, drive the pump motor 171 such that the detergent (softener) accommodated in the storage area 101 may be supplied to the tub 20.

For example, the controller 200 may drive the second pump motor 171*b* such that the detergent (softener) accommodated in the second storage area 101*b* may be supplied to the tub 20.

Figure 6:
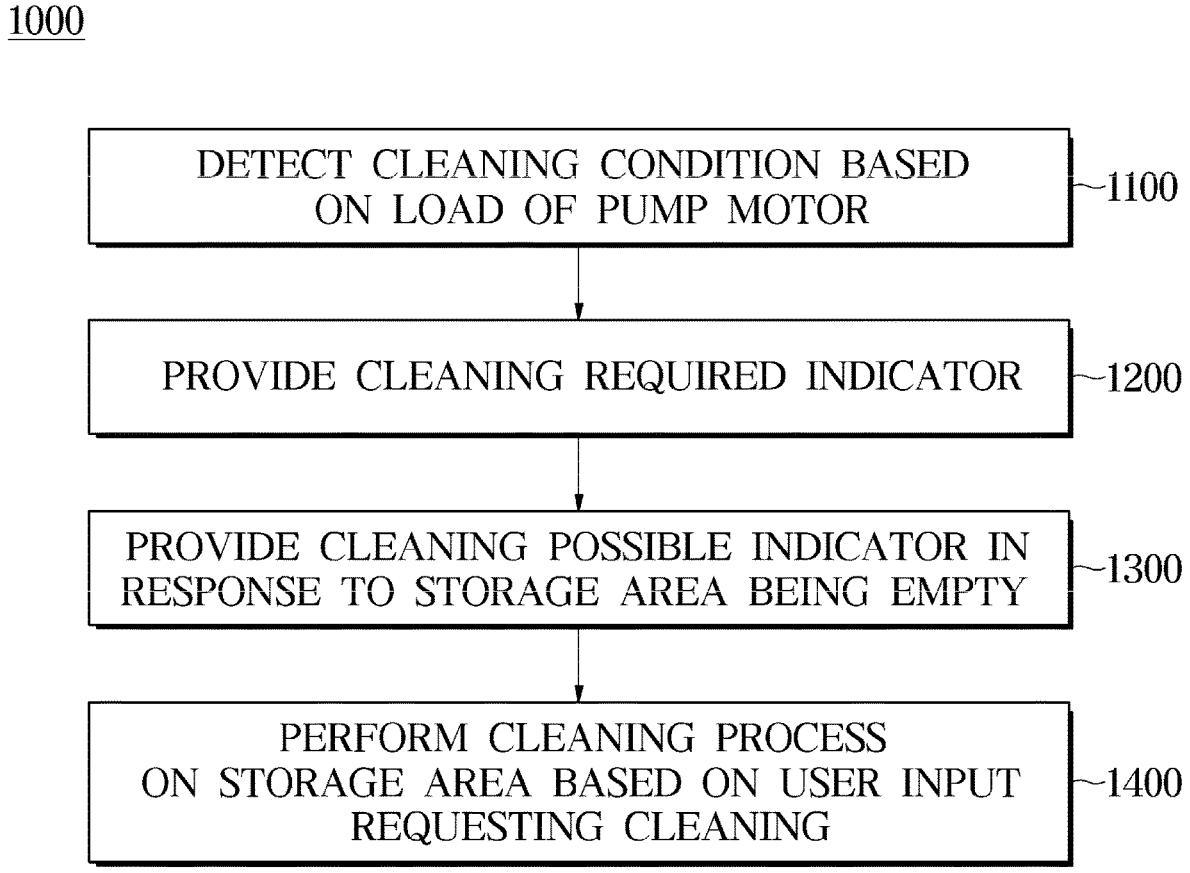
FIG. 6 is a flowchart showing a procedure of detecting a cleaning condition of a detergent supply device by a washing machine according to an embodiment.

FIG. 6 is a flowchart showing a process of detecting a cleaning condition of a detergent supply device by a washing machine according to an embodiment.

Referring to FIG. 6, the controller 200 may detect a cleaning condition of the storage area 101 based on the load of the pump motor 171 (1100).

The detecting of the cleaning condition of the storage area 101 refers to detecting a cleaning condition of the pump motor 171. In addition, the detecting of the cleaning condition of the storage area 101 refers to detecting whether storage area 101 needs cleaning or detecting whether the pump motor 171 needs cleaning.

For example, the controller 200 may drive the first pump motor 171*a* in the water supply operation 1012 during the wash process 1010, and, detect the cleaning condition of the first storage area 101*a* based on a load of the first pump motor 171*a* while the first pump motor 171*a* is being driven.

As another example, the controller 200 may drive the second pump motor 171*b* in the water supply operation 1021 during the rinse process 1020, and detect the cleaning condition of the second storage area 101*b* based on a load of the second pump motor 171*b* while the second pump motor 171*b* is being driven.

In an embodiment, the controller 200 may detect the cleaning condition of the storage area 101 in response to a load of the pump motor 171 being greater than a preset load for a predetermined time during operation of the pump motor 171.

To this end, the memory 220 may store a program or instructions for determining whether a load of the pump motor 171 is greater than a preset load for a predetermined time during operation of the pump motor 171.

According to various embodiments, the controller 200 may receive data about a driving voltage value of the pump motor 171 from a voltage sensor 175 that measures a voltage value for driving the pump motor 171.

The controller 200 may detect the cleaning condition of the storage area 101 in response to the driving voltage value of the pump motor 171 being greater than or equal to a predetermined value.

That is, the controller 200 may detect the cleaning condition of the storage area 101 in response to the driving voltage value of the pump motor 171 being greater than a preset voltage value for a predetermined time during operation of the pump motor 171.

For example, the controller 200 may drive the first pump motor 171*a* in the water supply operation 1012 during the wash process 1010, and in response that the driving voltage value of the first pump motor 171*a* is greater than or equal to a preset voltage value for a predetermined time while the first pump motor 171*a* is being driven, determine that the first storage area 101*a* (or the first pump motor 171*a*) needs cleaning.

As another example, the controller 200 may drive the second pump motor 171*b* in the water supply operation 1021 during the rinse process 1020, and in response that the driving voltage value of the second pump motor 171*b* is greater than or equal to a preset voltage value for a predetermined time while the second pump motor 171*b* is being driven, determine that the second storage area 101*b* (or the second pump motor 171*b*) needs cleaning.

That is, the controller 200 may drive the pump motor 171 during the wash process 1010 and/or the rinse process 1020, and detect the cleaning condition of the storage area 101 based on the driving voltage value of the pump motor 171.

The controller 200 may, based on detecting the cleaning condition of the storage area 101, control the user interface device 16 to provide an indicator notifying that the storage area 101 needs cleaning (1200).

That is, the controller 200 may, based on detecting the cleaning condition of the storage area 101 during the wash process 1010 and/or the rinse process 1020, control the user interface device 16 to provide an indicator notifying that the storage area 101 needs cleaning.

According to various embodiments, the controller 200 may control the user interface device 16 to provide an indicator notifying that the storage area 101 needs cleaning after the laundry cycle 1000 ends, or may control the user interface device 16 to immediately provide an indicator notifying that the storage area 101 needs cleaning in response to detecting the cleaning condition.

In an embodiment, the controller 200 may, in response to determination that the first storage area 101*a* needs cleaning, which is determined during the wash process 1010, control the user interface device 16 to provide an indicator notifying that the first storage area 101*a* needs cleaning.

In addition, the controller 200 may, in response to determination that the second storage area 101*b* needs cleaning, which is determined during the rinse process 1020, control the user interface device 16 to provide an indicator notifying that the second storage area 101*b* needs cleaning.

The indicator notifying that the storage area 101 needs cleaning may include various sensory indicators, such as a visual indicator and an audible indicator.

The indicator notifying that the storage area 101 needs cleaning may include information indicating a storage area 101 for which cleaning is needed among the plurality of storage areas 101, and the position in which the corresponding storage area 101 is located.

Figure 7:
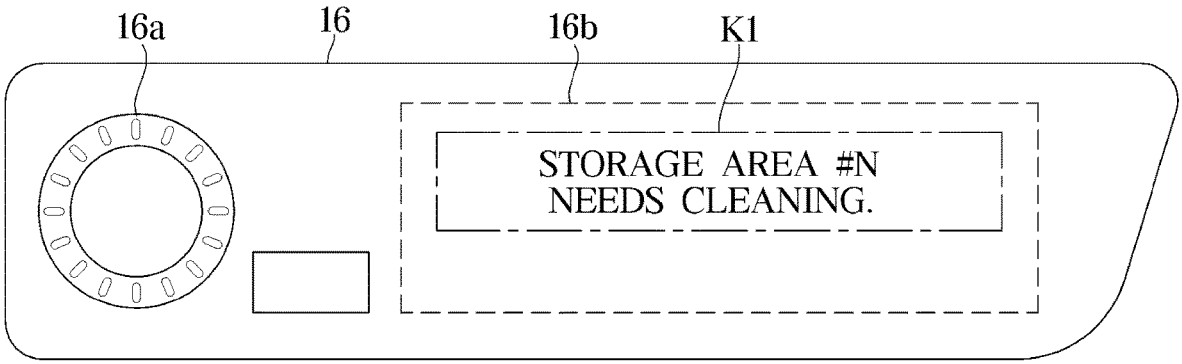
FIG. 7 is a view illustrating an example in which an indicator notifying a need to clean a storage area is provided by a washing machine according to an embodiment.

FIG. 7 is a view illustrating an example in which an indicator notifying a need to clean a storage area is provided by a washing machine according to an embodiment.

Referring to FIG. 7, the controller 200 may control the output interface 16*b* to provide an indicator K1 notifying that the storage area 101 needs cleaning.

The output interface 16*b* may be a display outputting visual information, and the indicator K1 may be a visual indicator.

The controller 200 may control the output interface 16*b* (e.g., a display) to display a visual indicator K1 notifying that the storage area 101 needs cleaning.

The visual indicator may be implemented in a form such as a screen including phrases, figures, texts, icons, and the like.

According to various embodiments, the output interface 16*b* may be a speaker outputting auditory information, and the indicator may be an auditory indicator.

The controller 200 may control the output interface 16*b* (e.g., a speaker) to output an audible indicator notifying that the storage area 101 needs cleaning.

The auditory indicator may be implemented in various forms such as speeches and warning sound.

According to the disclosure, a user may easily recognize that the storage area 101 needs cleaning, and accordingly, management of the detergent supply device 100 may be facilitated.

Figure 8:
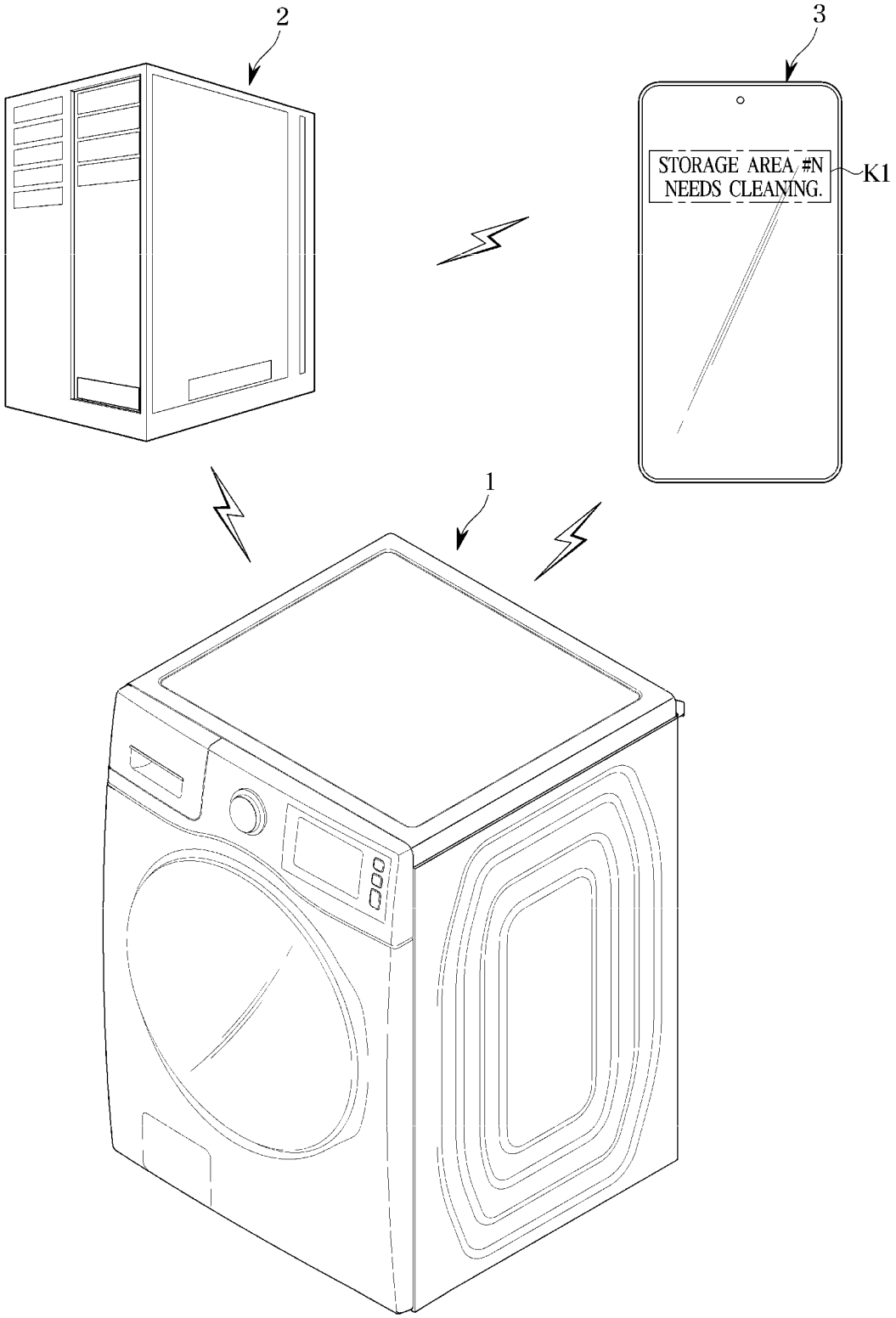
FIG. 8 is a view illustrating an example in which an indicator notifying a need to clean a storage area is provided a user device.

FIG. 8 is a view illustrating an example in which an indicator notifying a need to clean a storage area is provided a user device.

According to various embodiments, the user interface device 16 may include the communication module 16*c*.

The controller 200 may control the communication module 16*c* to transmit a message notifying the user device 3 that the storage area 101 needs cleaning. In this case, the user device 3 may include various devices capable of wireless communication, such as a smart phone and a smart watch.

Providing an indicator notifying that the storage area 101 needs cleaning may include transmitting, to the user device 3, a message notifying that the storage area 101 needs cleaning through the communication module 16*c*.

Referring to FIG. 8, the washing machine 1 according to an embodiment may, based on detecting the cleaning condition of the storage area 101, transmit a message notifying that the storage area 101 needs cleaning to the user device 3 via the server 2.

According to various embodiments, when short-range communication between the washing machine 1 and the user device 3 is established, the washing machine 1 may, based on detecting the cleaning condition of the storage area 101, directly transmit a message notifying that the storage area 101 needs cleaning to the user device 3.

The user device 3 may, in response to receiving the message notifying that the storage area 101 needs cleaning, provide an indicator notifying that the storage area 101 needs cleaning.

For example, the user device 3 may output a visual indicator K1 notifying that the storage area 101 needs cleaning, or output an audible indicator (or a tactile indicator). In this case, the tactile indicator may include vibration.

According to the disclosure, the user may easily recognize that the storage area 101 of the washing machine 1 needs cleaning through the user device 3, and accordingly, the management of the detergent supply device 100 may be facilitated.

Although not shown in the drawing, according to various embodiments, the controller 200 may control the communication module 16*c* to transmit a message notifying that the storage area 101 needs cleaning to other home appliances.

Other home appliances may include, for example, a refrigerator, a television, and the like, which are disposed in a place to be checked by users frequently.

In a case that the other home appliance includes a device (e.g., a display, a speaker, and the like) capable of providing an indicator notifying that the storage area 101 needs cleaning, the other home appliance may, in response to receiving a message notifying that the storage area 101 needs cleaning, provide an indicator notifying that the storage area 101 needs cleaning.

According to the related art, it is not easy for a user to determine when to clean the storage area (or the pump motor) of the detergent supply device.

On the other hand, according to the disclosure, the user may easily determine when to clean the storage area 101 (or the pump motor 171) of the detergent supply device 100, so that cleaning may be performed before the detergent in the storage area 101 is solidified.

Meanwhile, even when the user identifies when to clean the storage area 101 (or the pump motor 171) of the detergent supply device 100, there is an inconvenience of needing to remove all the detergent stored in the storage area 101 to clean the storage area 101. That is, in order to clean the storage area 101, emptying the storage area 101 needs to be preceded. Accordingly, according to various embodiments, operation 1200 of FIG. 6 may be omitted.

The controller 200 may determine whether the amount of a liquid accommodated in the storage area 101 is less than a threshold value through the detergent detecting sensor 173.

The controller 200 may control the detergent detecting sensor 173 to detect the liquid accommodated in the storage area 101. For example, the controller 200 may, in response to satisfying a predetermined condition, operate the detergent detecting sensor 173. When the detergent detecting sensor 173 is implemented as an electrode sensor, the operating of the detergent detecting sensor 173 may include applying a current to the electrode sensor.

For example, the controller 200 may, upon an electrical signal being generated in response that the power button of the washing machine 1 is pressed, operate the detergent detecting sensor 173.

As another example, the controller 200 may, in response to detecting that the detergent container 150 has been withdrawn from the housing 140 and then mounted thereon, operate the detergent detecting sensor 173. To this end, the detergent supply device 100 may further include various sensors capable of detecting whether the detergent container 150 is withdrawn.

As another example, the controller 200 may, in response to the end of the laundry cycle 1000, operate the detergent detecting sensor 173.

Referring again to FIG. 6, the controller 200 may, based on a liquid in the storage area 101 not being detected by the detergent detecting sensor 173 while the cleaning condition of the storage area 101 is detected, control the user interface device 16 to provide an indicator notifying that cleaning of the storage area 101 is allowed (1300).

The indicator notifying that cleaning is allowed may include an indicator for inducing a user input requesting cleaning of the storage area 101.

The indicator notifying that cleaning of the storage area 101 is allowed may be distinguished from the indicator notifying that cleaning of the storage area 101 is needed. Being allowed to clean the storage area 101 may refer to when cleaning is needed and also cleaning is allowed. On the other hand, being needed to clean the storage area 101 may refer to when the storage area 101 should be emptied to perform cleaning because liquid is stored in the storage area 101, but currently the storage area 101 needs cleaning.

That is, the controller 200 may, in response that both the condition for cleaning necessity and the condition for cleaning allowability are satisfied, control the user interface device 16 to provide an indicator notifying that cleaning is allowed.

The indicator notifying that cleaning of the storage area 101 is allowed may include various sensory indicators, such as a visual indicator and an audible indicator.

The indicator notifying that cleaning of the storage area 101 is allowed may include information indicating a storage area 101 for which cleaning is needed among the plurality of storage areas 101, and the position in which the corresponding storage area 101 is located. In addition, the indicator notifying that cleaning of the storage area 101 is needed may include an indicator for inducing a user input requesting cleaning of the storage area 101.

According to the disclosure, when cleaning of the storage area 101 is needed and also allowed, a user may easily perform a manipulation for cleaning the storage area 101.

Figure 9:
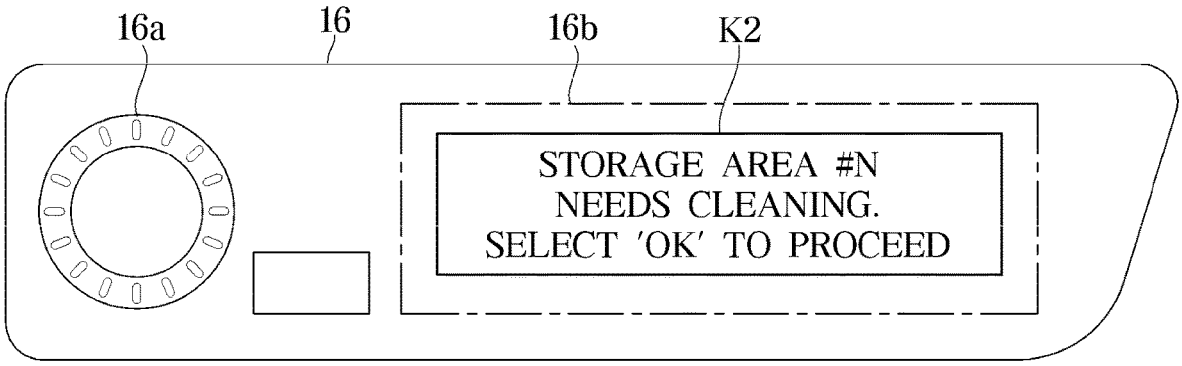
FIG. 9 is a view illustrating an example in which an indicator inducing a user input to start cleaning of a storage area is provided by a washing machine according to an embodiment.

FIG. 9 is a view illustrating an example in which an indicator inducing a user input to start cleaning a storage area is provided by a washing machine according to an embodiment.

Referring to FIG. 9, the controller 200 may control the output interface 16*b* to provide an indicator K2 notifying that cleaning of the storage area 101 is allowed.

The output interface 16*b* may be a display outputting visual information, and the indicator K2 may be a visual indicator.

The controller 200 may control the output interface 16*b* (e.g., a display) to display a visual indicator K2 notifying that cleaning of the storage area 101 is allowed.

The visual indicator may be implemented in various forms such as phrases, figures, texts, and icons. In this case, the visual indicator K2 may induce (or guide) a user to input a user input to clean the storage area 101. For example, the visual indicator K2 may be a phrase such as "Please select OK to proceed with cleaning of the storage area." That is, the visual indicator K2 may induce manipulation of the input interface 16*a* for cleaning.

Upon checking the visual indicator K2, the user, may manipulate the input interface 16*a*, to start cleaning the storage area 101.

For example, in response to a predetermined button included in the input interface 16*a* being pressed while the visual indicator K2 is output on the output interface 16*b*, a user interface for cleaning the storage area 101 may be provided on the output interface 16*b*.

Figure 10:
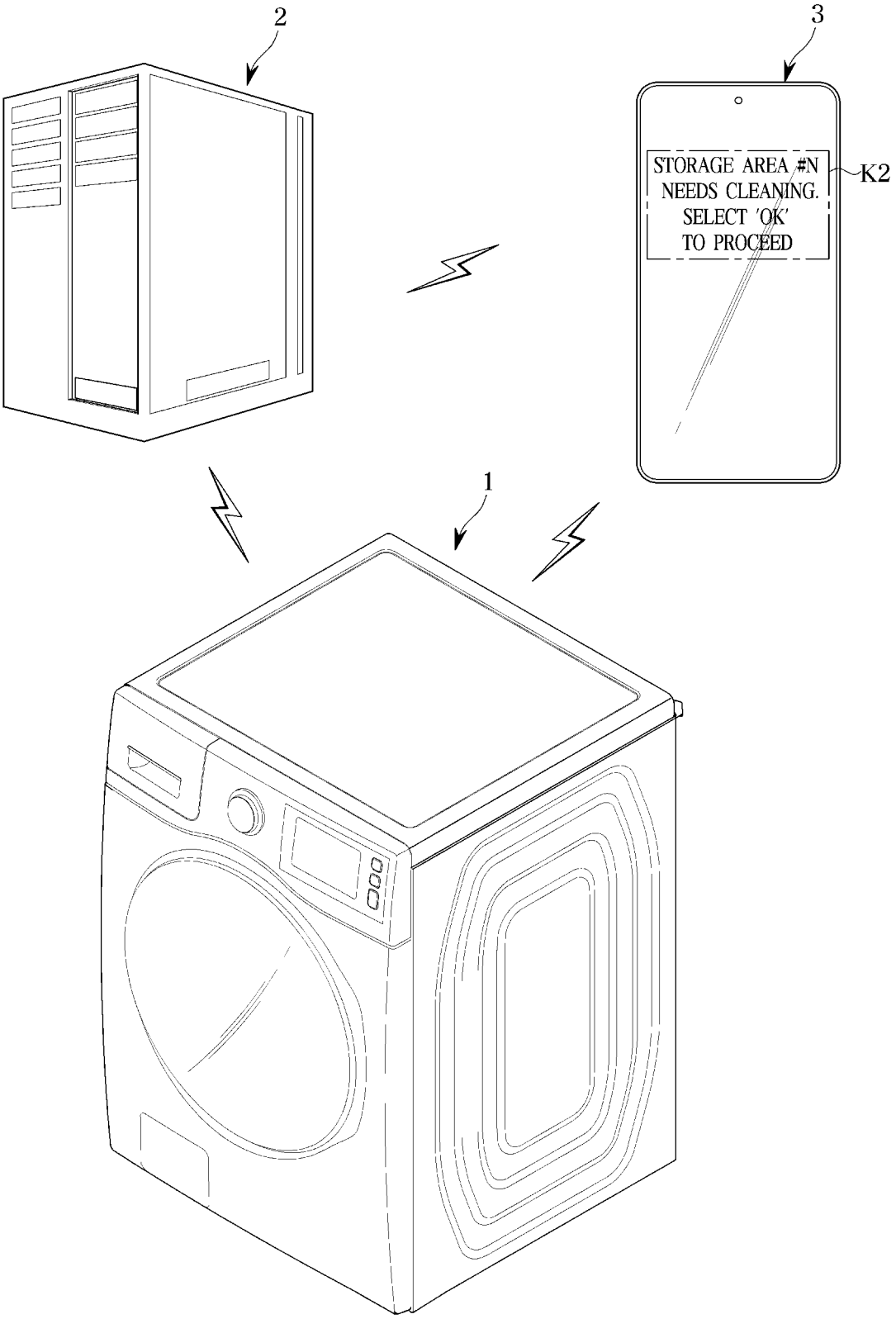
FIG. 10 is a view illustrating an example in which an indicator inducing a user input to start cleaning of a storage area is provided by a user device.

FIG. 10 is a view illustrating an example in which an indicator inducing a user input to start cleaning of a storage area is provided by a user device.

According to various embodiments, the user interface device 16 may include the communication module 16*c*.

The controller 200 may control the communication module 16*c* to send the user device a message notifying that cleaning of the storage area 101 is allowed. In this case, the user device may include various devices capable of wireless communication, such as a smart phone and a smart watch.

Providing an indicator notifying that cleaning of the storage area 101 is allowed may include transmitting, to the user device, a message notifying that cleaning of the storage area 101 is allowed through the communication module 16*c*.

Referring to FIG. 10, the washing machine 1 according to an embodiment may, based on the storage area 101 being empty while the cleaning condition of the storage area 101 is detected, transmit a message notifying that cleaning of the storage area 101 is allowed to the user device 3 via the server 2.

According to various embodiments, when short-range communication between the washing machine 1 and the user device 3 is established, the washing machine 1 may, based on the storage area 101 being empty while the cleaning condition of the storage area 101 is detected, directly transmit a message notifying that cleaning of the storage area 101 is allowed to the user device 3.

The user device 3 may, in response to receiving the message notifying that cleaning of the storage area 101 is allowed, provide an indicator notifying that cleaning of the storage area 101 is allowed.

For example, the user device 3 may output a visual indicator K2 notifying that cleaning of the storage area 101 is allowed, or output an audible indicator (or a tactile indicator). In this case, the tactile indicator may include vibration.

According to the disclosure, the user may easily recognize that cleaning of the storage area 101 of the washing machine 1 is allowed through the user device 3, and accordingly, the management of the detergent supply device 100 may be facilitated.

In an embodiment, it may be required to fill the storage area 101 with water to clean the storage area 101.

A cleaning process of the storage area 101 may include a process of operating the pump motor 171 while the storage area 101 is filled with water. When the pump motor 171 is operated while the water is full, the water may wash the inside of the detergent supply device 100 and remove the solidified detergent.

Figure 11:
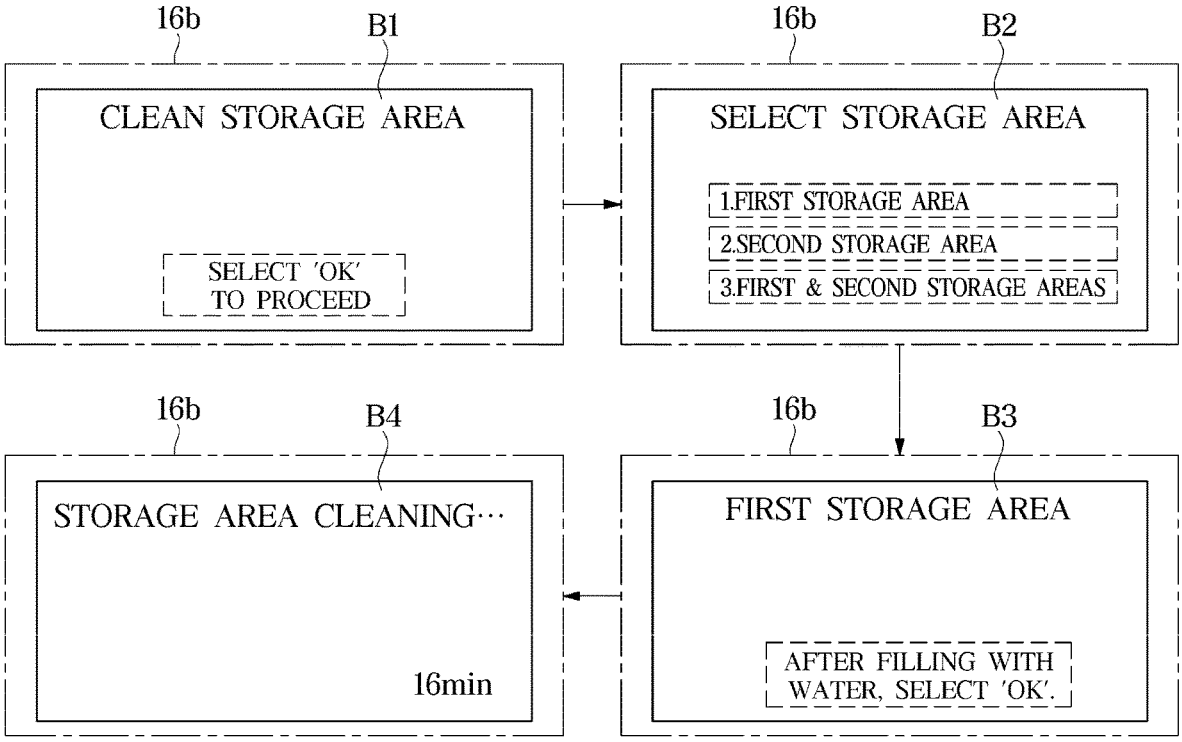
FIG. 11 is a view illustrating an example in which a user interface for cleaning a storage area is provided by a washing machine according to an embodiment.

FIG. 11 is a view illustrating an example in which a user interface for cleaning a storage area is provided by a washing machine according to an embodiment.

Referring to FIG. 11, a user interface for cleaning the storage area 101 may include a screen that sequentially switches according to a user input. The user interface for cleaning the storage area 101 may be provided through the user interface device 16.

In an embodiment, the user interface for cleaning the storage area 101 may include a first screen B1 for confirming a user's intention to clean the storage area.

The first screen B1 may be the same as the indicator K2 notifying that cleaning of the storage area 101 is allowed, but is not limited thereto.

The user interface for cleaning the storage area 101 may include a second screen B2 for selecting at least one storage area 101 to be cleaned from among the plurality of storage areas 101.

The controller 200 may, based on a user input confirming the intention to clean the storage area being received through the input interface 16*a* while the first screen B1 is being output on the output interface 16*b*, control the output interface 16*b* to provide the second screen B2.

The second screen B2 may include identifiers (e.g., names or numbers) corresponding respectively to the plurality of storage areas 101. For example, the second screen B2 may include an element for selecting the first storage area 101*a*, an element for selecting the second storage area 101*b*, and/or an element for selecting both the first storage area 101*a* and the second storage area 101*b*.

According to various embodiments, the controller 200 may set an element for selecting a storage area 101, of which a cleaning condition is detected, among the plurality of storage areas 101 as a default element.

An element may be set as a default element to, when a cleaning condition of the first storage area 101*a* is detected before the first screen B1 is provided through the output interface 16*b*, select the first storage area 101*a* on the second screen B2. By only selecting a confirmation button while the element for selecting the first storage area 101*a* is set as a default element on the second screen B2, the user may select the first storage area 101*a* as a storage area to be cleaned.

In addition, an element may be set as a default element to, when a cleaning condition of the second storage area 101*b* is detected before the first screen B1 is provided through the output interface 16*b*, select the second storage area 101*b* on the second screen B2.

In addition, an element may be set as a default element to, when a cleaning condition of the first storage area 101*a* and a cleaning condition of the second storage area 101*b* are detected before the first screen B1 is provided through the output interface 16*b*, select the first storage area 101*a* and the second storage area 101*b* on the second screen B2.

According to various embodiments, the controller 200 may set an element for selecting a storage area 101, of which a cleaning condition is detected and liquid is not detected, among the plurality of storage areas 101 as a default element.

The user interface for cleaning the storage area 101 may include a third screen B3 for guiding supply of water to the storage area 101 that is to be cleaned.

A user who has seen the third screen B3 may supply water to the storage area 101 to be cleaned.

According to various embodiments, when the detergent supply device 100 includes a configuration capable of supplying water to the storage area 101, an element requesting supply of water from the user may be omitted on the third screen B3.

The controller 200 may, based on a user input to select a storage area 101, which is to be cleaned, being received through the input interface 16*a* while the second screen B2 is being output on the output interface 16*b*, control the output interface 16*b* to provide the third screen B3.

The controller 200 may, based on a user input to start cleaning the selected storage area 101 being received through the input interface 16*a* while the third screen B3 is being output on the output interface 16*b*, start the cleaning process of the selected storage area 101.

The user interface for cleaning the storage area 101 may include a fourth screen B4 for guiding the cleaning progress of the selected storage area 101.

In response to a start of the cleaning process of the storage area 101, the user may check the progress of the cleaning through the fourth screen B4. For example, the fourth screen B4 may include an indicator notifying the remaining time of the storage area cleaning process, the current process, and the like.

According to various embodiments, the user input to request cleaning of the storage area 101 may include at least one of a user input to confirm an intention to clean the storage area 101, a user input to select the storage area 101 to be cleaned, or a user input to start cleaning the storage area 101.

A user input to request cleaning of the storage area 101 may be received through the user interface device 16. For example, the user input to request cleaning of the storage area 101 may be received through the input interface 16*a*.

According to various embodiments, the user input to request cleaning of the storage area 101 may be received from a user device through the communication module 16*c*. The user may transmit a command to request cleaning of the storage area 101 to the washing machine 1 through the user device.

Referring again to FIG. 6, the controller 200 may perform a cleaning process on the storage area 101 based on the user input to request cleaning (1400).

The process for cleaning the storage area 101 (hereinafter referred to as an "storage area cleaning process") may include at least one of a pump process for driving the pump motor 171, a water supply process for driving the water supply device 14, an agitation process for agitating the drum 30, a drain process for driving the drain device 70, or a spin-dry process for driving the drain device 70 while rotating the drum 30. In this case, each of the processes may be performed simultaneously. For example, the water supply process and the pump process may be performed simultaneously.

The controller 200 may control the pump motor 171, the water supply device 14, the driving device 60, and the drain device 70 to perform the storage area cleaning process.

The pump process is a process for driving the pump motor 171 to clean the pump motor 171 inside the detergent supply device 100.

The pump process may include a first pump process for driving the first pump motor 171*a*, a second pump process for driving the second pump motor 171*b*, and a third pump process for driving at least one of the first pump motor 171*a* or the second pump motor 171*b*. During the third pump process, the controller 200 may drive both the first pump motor 171*a* and the second pump motor 171*b*, may drive only the first pump motor 171*a*, or may drive only the second pump motor 171*b*.

The water supply process is a process for supplying water to the inside of the tub 20 to prevent a detergent removed from the detergent supply device 100 from adhering to the inside of the tub 20.

The controller 200 may, during the water supply process, operate the water supply device 14 until the water level in the tub 20 reaches a preset water level. To this end, the washing machine 1 may further include a water level sensor for detecting the water level in the tub 20.

The agitation process is a process for preventing the detergent removed from the detergent supply device 100 from sinking to the bottom of the tub 20. That is, the agitation process is a process for mixing the water supplied into the tub 20 in the water supply process with the detergent separated in the pump process and sent into the tub 20.

The controller 200 may, during the agitation process, rotate the drum 30 clockwise and counterclockwise. In addition, the controller 200 may, during the agitation process, rotate the drum 30 clockwise n times (n is a natural number) and counterclockwise n times. Accordingly, after the agitation process is finished, the drum 30 may return to its original position.

The drain process is a process for discharging a mixture of the water supplied into the tub 20 in the water supply process and the detergent separated and sent into the tub 20 in the pump process to the outside of the washing machine 1.

The spin-dry process is a process for completely removing water inside the tub 20 after the drain process.

According to the disclosure, the detergent supply device 100 may be cleaned without contaminating the inside of the tub 20 through the pump process, the water supply process, the agitation process, the drain process, and the spin-dry process.

The controller 200 may, in response to the start of the storage area cleaning process, start a pump process, and in response to that liquid is not detected by the detergent detecting sensor 173, end the pump process.

That is, the controller 200 may, upon a start of the storage area cleaning process, perform the pump process until the water in the storage area 101 is exhausted.

The controller 200 may perform each of the water supply process and the agitation process at least once before an ending of the pump process from the start of the storage area cleaning process.

According to the disclosure, the inside of the tub 20 may be prevented from being contaminated while the solidified detergent is being removed from the detergent supply device 100.

The controller 200 may perform each of the water supply process, the drain process, and the spin-dry process at least once in response that the pump process ends.

According to the disclosure, the inside of the tub 20 may be prevented from being contaminated by repeatedly cleaning the inside of the tub 20. In addition, according to the disclosure, the inside of the tub 20 may be prevented from becoming wet after the storage area cleaning process.

The storage area cleaning process may include a first cleaning process for cleaning only the first storage area 101*a*, a second cleaning process for cleaning only the second storage area 101*b*, and a third cleaning process for cleaning both the first storage area 101*a* and the second storage area 101*b*.

On the other hand, according to various embodiments, when the detergent supply device 100 includes a configuration capable of supplying water to the storage area 101, the storage area cleaning process may further include a storage area water supply process of supplying water to the storage area 101. In this case, the storage area water supply process may be preemptively performed before the pump process.

Figure 12:
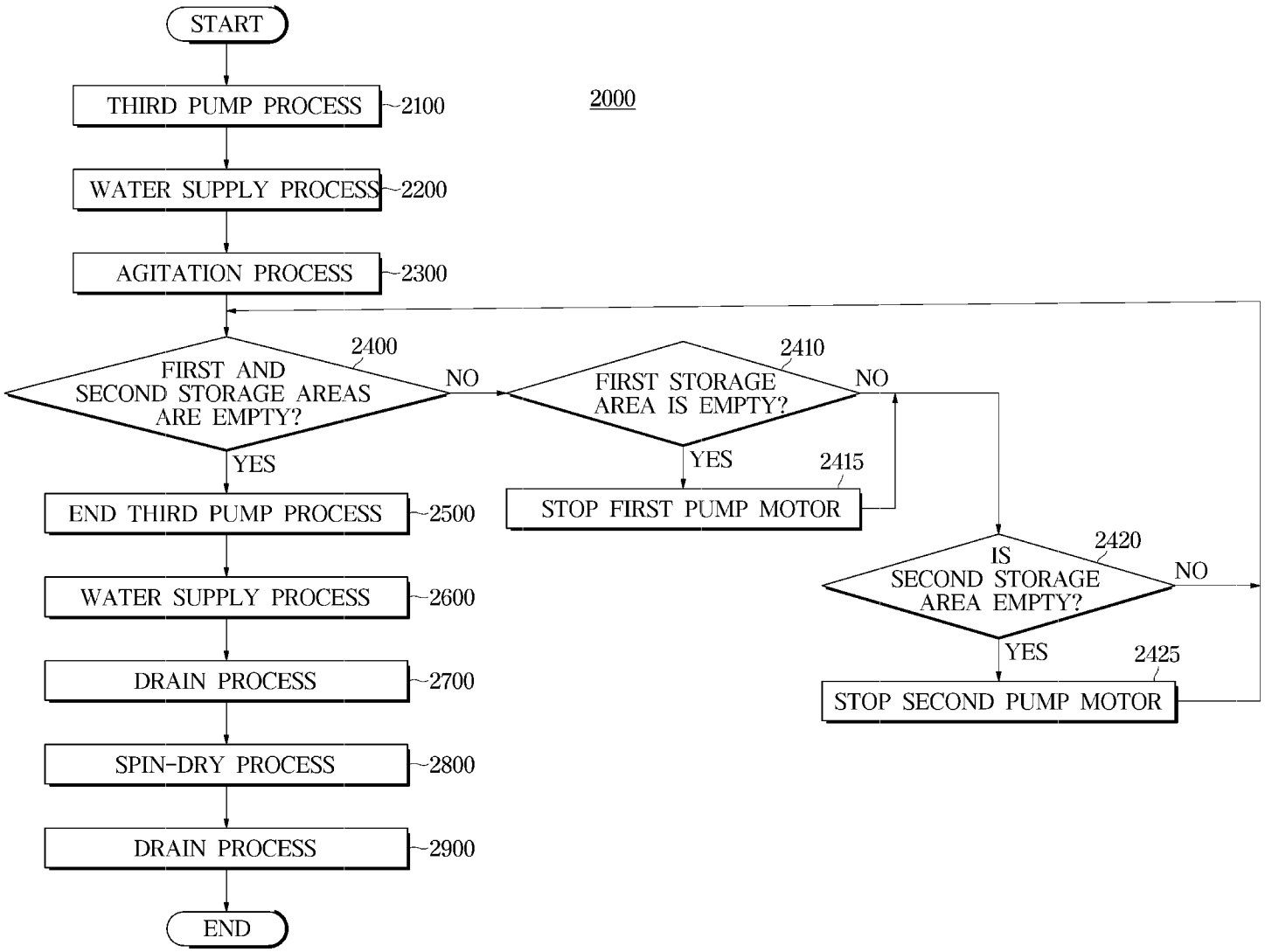
FIG. 12 is a flowchart showing a process for cleaning a plurality of storage areas according to an embodiment.

FIG. 12 is a flowchart showing a process for cleaning a plurality of storage areas according to an embodiment.

Referring to FIG. 12, the third cleaning process will be described.

A user input to start the third cleaning process may be received through the user interface device 16.

The controller 200 may, in response to receiving a user input to start the third cleaning process 2000, start a third pump process (2100). That is, the controller 200 may, in response to receiving a user input to start the third cleaning process, drive both the first pump motor 171*a* and the second pump motor 171*b*.

The controller 200 may, during the third pump process, operate the detergent detecting sensor 173.

The controller 200 may, based on a liquid not being detected in the first storage area 101*a* during the third pump process (YES in operation 2410), stop the first pump motor 171*a* (2415).

Similarly, the controller 200 may, based on liquid not being detected in the second storage area 101*b* during the third pump process (YES in operation 2420), stop the second pump motor 171*b* (2425).

That is, the controller 200 may, in response to water accommodated in the first storage area 101*a* disappearing before water accommodated in the second storage area 101*b*, drive only the second pump motor 171*b* for a predetermined period, and in response to water accommodated in the second storage area 101*b* disappearing before water accommodated in the first storage area 101*a*, drive only the first pump motor 171*a* for a predetermined period.

In an embodiment, the controller 200 may perform the water supply process and the agitation process at least once before stopping both the first pump motor 171*a* and the second pump motor 171*b* (2200 and 2300).

According to various embodiments, the controller 200 may operate the second pump motor 171*b* according to a predetermined cycle while continuously operating the first pump motor 171*a* during the third pump process.

For example, the controller 200 may simultaneously operate the first pump motor 171*a* and the second pump motor 171*b* for a predetermined time, operate only the first pump motor 171*a* for a predetermined time, and then simultaneously operate the first pump motor 171*a* and the second pump motor 171*b* for a predetermined time.

According to various embodiments, the controller 200 may stop the second pump motor 171*b* while the water supply device 14 is operating.

According to the disclosure, it is possible to overcome the capacity limit of the power supply device for supplying power to the first pump motor 171*a*, the second pump motor 171*b*, and the water supply valve 14*b*.

The controller 200 may, in response to a liquid not being detected in both the first storage area 101*a* and the second storage area 101*b* (YES in operation 2400), ends the third pump process (2500).

The controller 200 may perform the water supply process, the drain process, and the spin-dry process at least once after the third pump process ends (2600, 2700, 2800, and 2900).

For example, the controller 200 may repeatedly perform the water supply process and the drain process after the third pumping process ends. For example, the controller 200 may repeatedly perform the water supply process and the drain process at least twice after the third pump process ends.

As the water supply process and the water drain process are repeated, the inside of the tub 20 may be washed clean.

The controller 200 may, in response to an ending of the last drain process, perform a spin-dry process and then a drain process (2800 and 2900).

According to the disclosure, the inside of the tub 20 may be effectively prevented from being contaminated.

Figure 13:
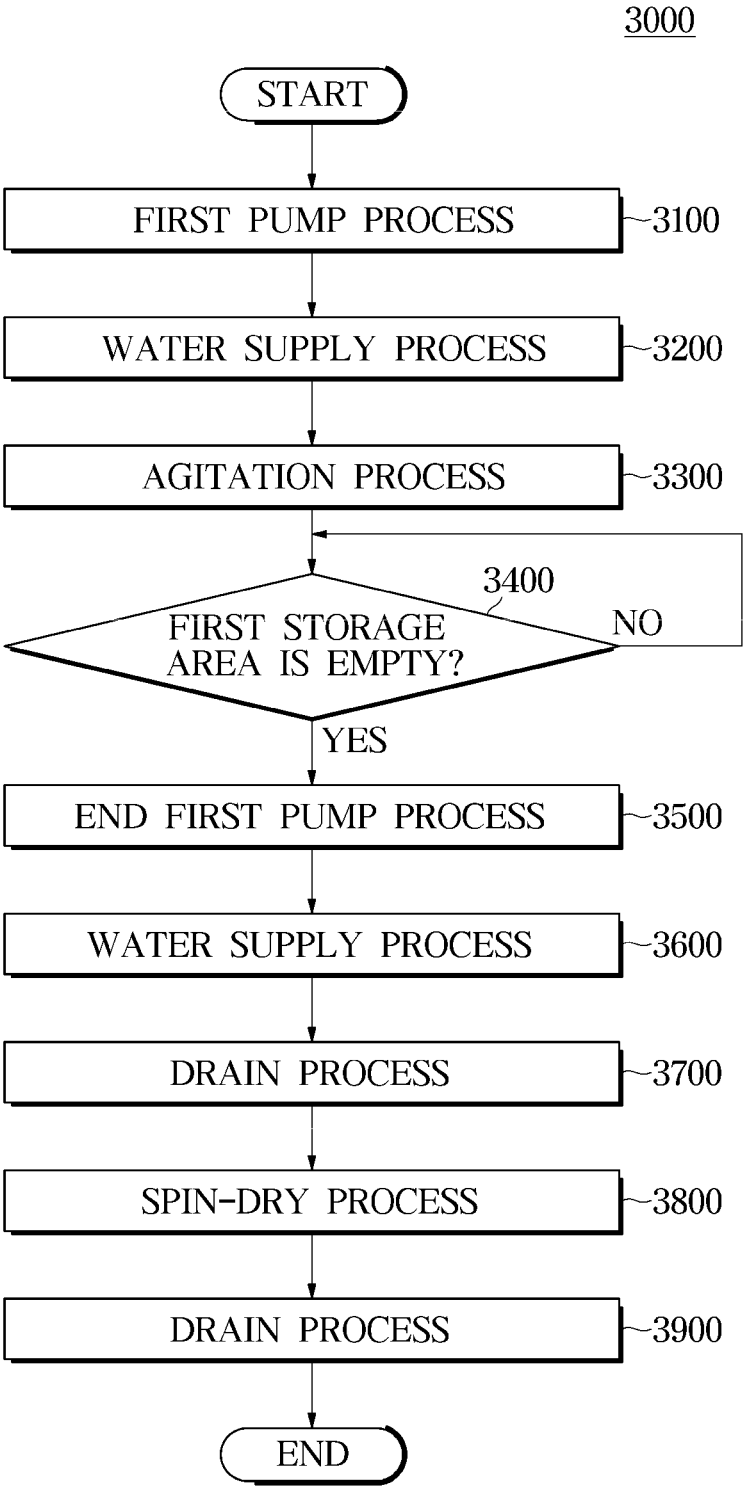
FIG. 13 is a flowchart showing a process for cleaning one storage area according to an embodiment.

FIG. 13 is a flowchart showing a process for cleaning one storage area according to an embodiment.

The first cleaning process will be described with reference to FIG. 13.

A user input to start the first cleaning process may be received through the user interface device 16.

The controller 200 may, in response to receiving a user input to start the first cleaning process 3000, start the first pump process (3100). That is, the controller 200 may, in response to receiving a user input to start the first cleaning process, drive the first pump motor 171*a*.

The controller 200 may operate the detergent detecting sensor 173 during the first pump process.

The controller 200 may, based on a liquid not being detected in the first storage area 101*a* during the first pump process (YES in operation in 3400), end the first pump process (3500).

That is, the controller 200 may, based on a liquid not being detected in the first storage area 101*a* during driving of the first pump motor 171*a* (YES in operation 3400), stop the first pump motor 171*a*.

In an embodiment, the controller 200 may perform the water supply process and the agitation process at least once before stopping the first pump motor 171 (3200 and 3300).

According to various embodiments, the controller 200 may continuously operate the first pump motor 171*a* during the first pump process.

The controller 200 may perform the water supply process, the drain process, and the spin-dry process at least once after ending the first pump operation (3600, 3700, 3800, and 3900).

For example, the controller 200 may repeatedly perform the water supply process and the drain process after the first pump process ends. For example, the controller 200 may repeatedly perform the water supply process and the drain process at least twice after the first pump process ends.

As the water supply process and the water drain process are repeated, the inside of the tub 20 may be washed clean.

The controller 200 may, in response to ending of the last drain process, perform a spin-dry process and then a drain process (3800 and 3900).

According to the disclosure, the inside of the tub 20 may be effectively prevented from being contaminated.

Figure 14:
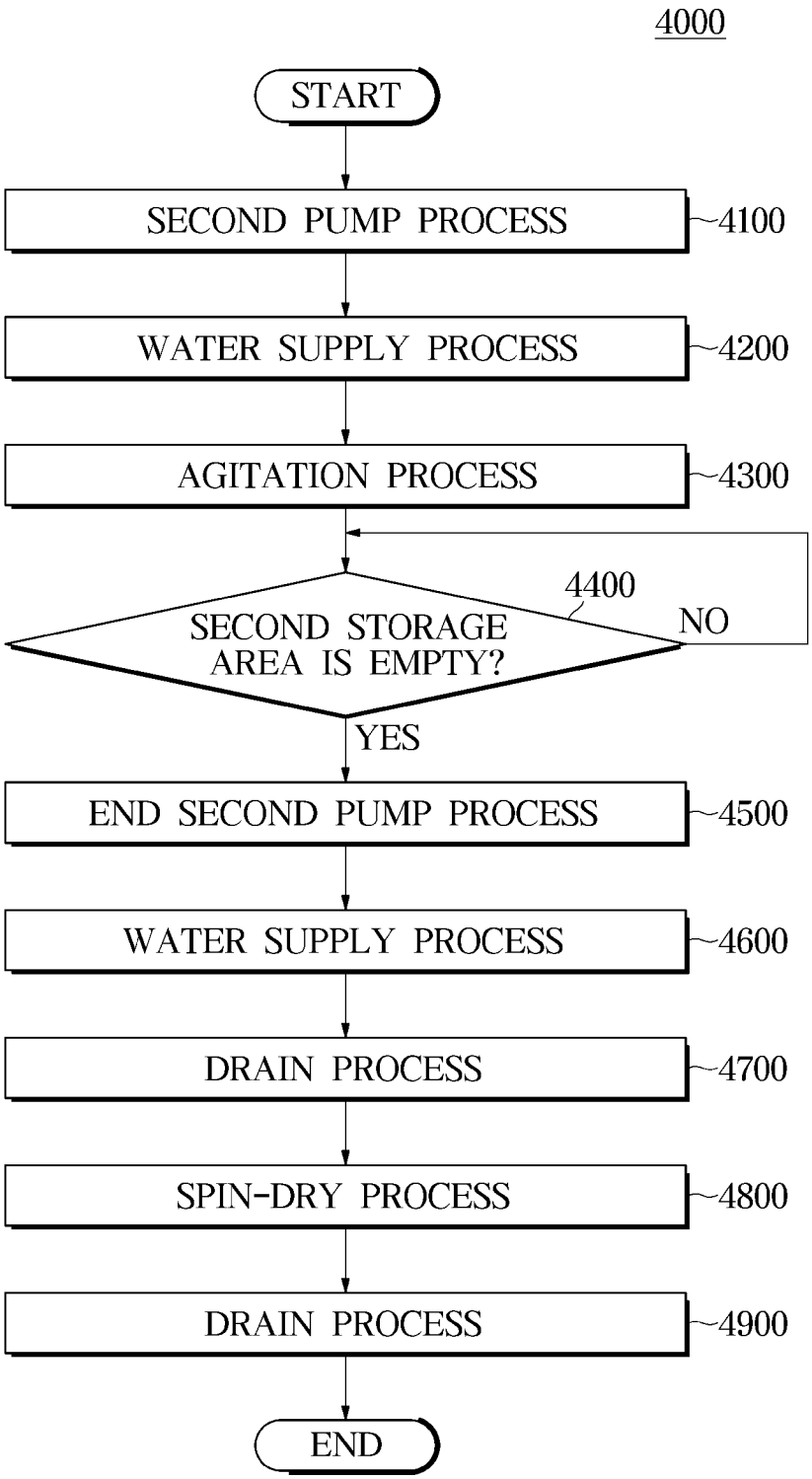
FIG. 14 is a flowchart showing a process for cleaning another storage area according to an embodiment.

FIG. 14 is a flowchart showing a process for cleaning another storage area according to an embodiment.

Referring to FIG. 14, the second cleaning process will be described.

A user input to start the second cleaning process may be received through the user interface device 16.

The controller 200 may, in response to receiving a user input to start the second cleaning process 4000, start the second pump process (4100). That is, the controller 200 may, in response to receiving a user input to start the second cleaning process, drive the second pump motor 171*b*.

The controller 200 may operate the detergent detecting sensor 173 during the second pump process.

The controller 200 may, based on a liquid not being detected in the second storage area 101*b* during the second pump process (YES in operation 4400), end the second pump process (4500).

That is, the controller 200 may, based on a liquid not being detected in the second storage area 101*b* during driving of the second pump motor 171*b* (YES in operation 4400), stop the second pump motor 171*b*.

In an embodiment, the controller 200 may perform the water supply process and the agitation process at least once before stopping the second pump motor 171 (4200 and 4300).

According to various embodiments, the controller 200 may continuously operate the second pump motor 171*b* during the second pump process.

The controller 200 may perform the water supply process, the drain process, and the spin-dry process at least once after the second pumping process ends (4600, 4700, 4800, and 4900).

For example, the controller 200 may repeatedly perform the water supply process and the drain process after the second pump process ends. For example, the controller 200 may repeatedly perform the water supply process and the drain process at least twice after the second pump process ends.

As the water supply process and the water drain process are repeated, the inside of the tub 20 may be washed clean.

The controller 200 may, in response to ending of the last drain process, perform a spin-dry process and then a drain process (4800 and 4900).

According to the disclosure, the inside of the tub 20 may be effectively prevented from being contaminated.

Meanwhile, each of the first storage area 101*a* and the second storage area 101*b* may be set in advance to store a different detergent.

For example, the first storage area 101*a* may be used for storing a detergent (a laundry detergent) flowing into the tub 20 in the wash process 1010, and the second storage area 101*b* may be used for storing a detergent (a softener) flowing into the tub 20 in the rinse process 1020.

That is, the first storage area 101*a* may correspond to a detergent compartment, and the second storage area 101*b* may correspond to a softener compartment.

The memory 220 may store at least one instruction for supplying the detergent accommodated in the detergent compartment to the inside of the tub 20 in the wash process 1010 and providing the detergent accommodated in the softener compartment to the inside of the tub 20 in the rinse process 1020.

According to the related art, the user needs to put only a detergent (a laundry detergent) into a storage area corresponding to a detergent compartment, and put only a detergent (softener) into a storage area corresponding to a softener compartment.

However, as the number of users who use washing machines is diverse, there is a user demand for changing the use of a storage area.

The washing machine 1 according to an embodiment may provide a function of changing the use of the storage area 101.

In an embodiment, the first storage area 101*a* may be set for use as a detergent compartment, and the second storage area 101*b* may be set for use as a softener compartment, but the use of the second storage area 101*b* may be changed into a detergent compartment.

To this end, the memory 220 may store a program for changing the use of the storage area 101.

Figure 15:
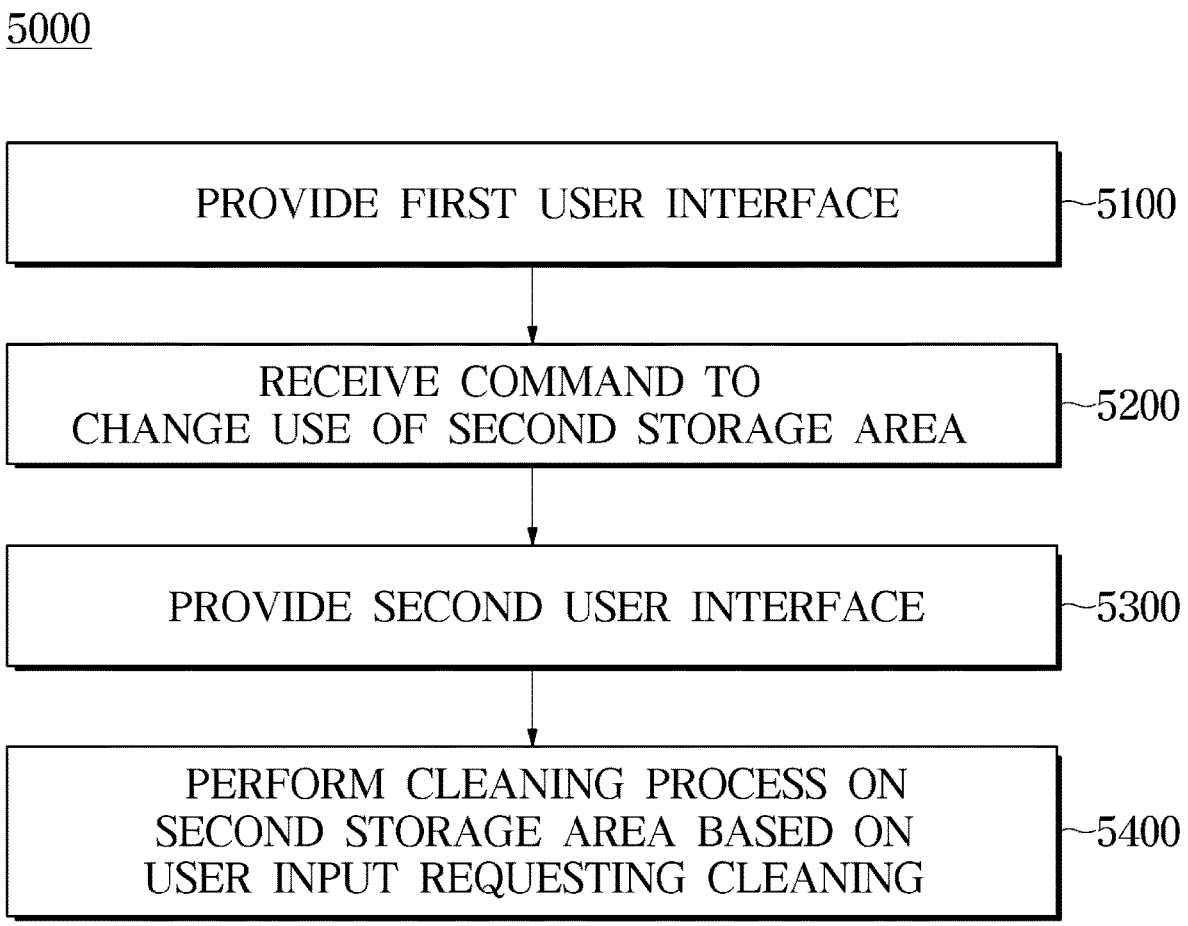
FIG. 15 is a flowchart showing a procedure for changing the use of a storage area in a washing machine according to an embodiment.

FIG. 15 is a flowchart showing a procedure for changing the use of a storage area in a washing machine according to an embodiment.

Referring to FIG. 15, a procedure (5000) for changing the use of the storage area 101 in the washing machine 1 according to an embodiment is described.

The controller 200 may control the user interface device 16 to provide a first user interface for setting the use of the second storage area 101*b* as a detergent compartment or a softener compartment.

Accordingly, the user interface device 16 may provide the first user interface for setting the use of the second storage area 101*b* as a detergent compartment or a softener compartment (5100).

The user interface device 16 may receive a command to change the use of the second storage area 101*b* through the first user interface (5200).

For example, the user interface device 16 may change the use of the second storage area 101*b* from a detergent compartment to a softener compartment or from a softener compartment to a detergent compartment through the first user interface.

In an embodiment, the controller 200 may, in response to the use of the second storage area 101*b* being changed through the first user interface, control the user interface device 16 to provide a second user interface for requesting cleaning of the second storage area 101*b*.

For example, the controller 200 may, in response to the use of the second storage area 101*b* being set from a detergent compartment to a softener compartment through the first user interface, control the user interface device 16 to provide a second user interface for requesting cleaning of the second storage area 101*b*.

As another example, the controller 200 may, in response to the use of the second storage area 101*b* being set from a softener compartment to a detergent compartment through the first user interface, control the user interface device 16 to provide a second user interface for requesting cleaning of the second storage area 101*b*.

The user interface device 16 may, in response to the use of the second storage area 101*b* being changed through the first user interface, provide the second user interface for requesting cleaning of the second storage area 101*b* (5300).

Thereafter, the controller 200 may, in response to a user input requesting cleaning of the second storage area 101*b* being received through the user interface device 16, perform a clean process on the second storage area 101*b* (5400).

When the use of the second storage area 101*b* is changed, laundry detergent or softener remaining in the second storage area 101*b* may be combined with newly added softener or laundry detergent and stuck. Accordingly, when the use of the second storage area 101*b* is changed, the second storage area 101*b* needs cleaning once.

According to the disclosure, in response to a change in the use of the second storage area 101*b*, a user interface for cleaning the second storage area 101*b* may be automatically provided so that detergent inside the second storage area 101*b*, of which the use has been changed, may be prevented from sticking.

Figure 16:
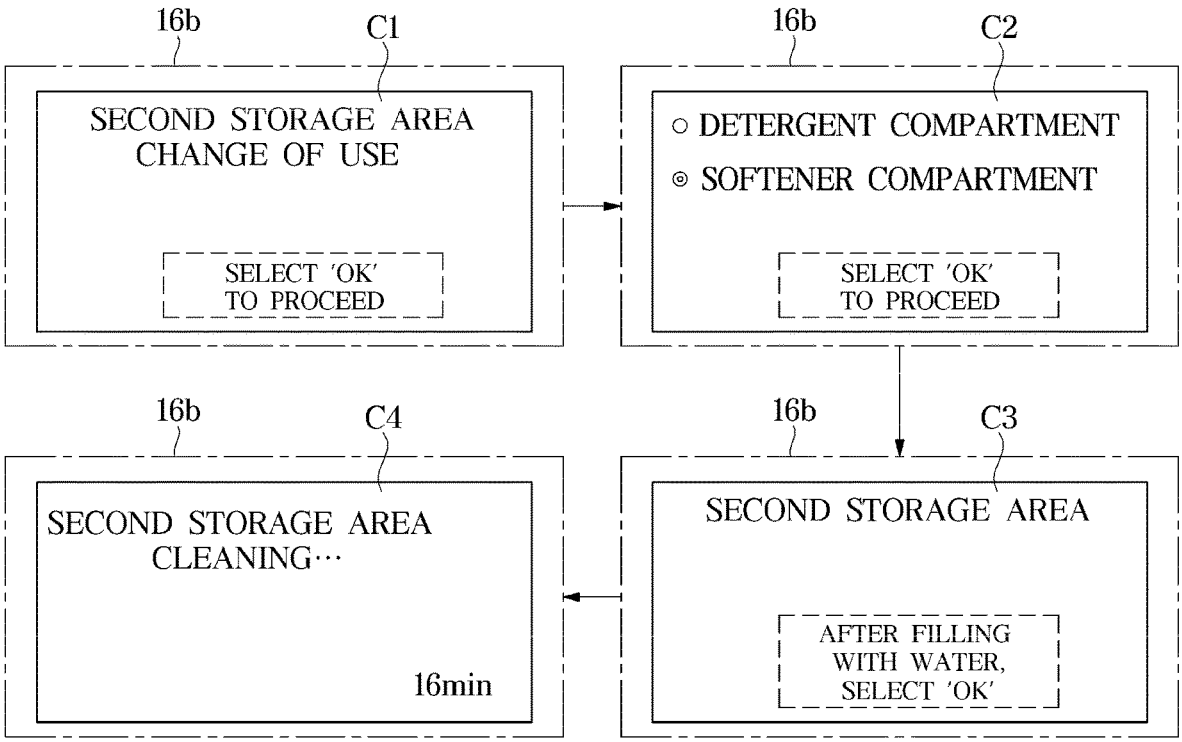
FIG. 16 is a view illustrating an example in which a user interface for changing the use of a storage area is provided by a washing machine according to an embodiment.

FIG. 16 is a view illustrating an example in which a user interface for changing the use of a storage area is provided by a washing machine according to an embodiment.

Referring to FIG. 16, a first user interface may include a screen C1 for checking an intention to change the use of the second storage area 101*b*.

The screen C1 may include an indicator for checking an intention to change the use of the second storage area 101*b*.

The controller 200 may, in response to a user input to check an intention to change the use of the second storage area 101*b* being received through the input interface 16*a* while the screen C1 is being output on the output interface 16*b*, control the user interface device 16 to output a screen C2 for selecting the use of the storage area 101*b*.

The screen C2 for selecting the use of the second storage area 101*b* may include an element for selecting a detergent compartment or a softener compartment.

The controller 200 may, in response to a command to change the use of the second storage area 101*b* being received through the input interface 16*a* while the screen C2 is being output on the output interface 16*b*, control the user interface device 16 to provide a second user interface for requesting cleaning of the second storage area 101*b*.

The second user interface may include a screen C3 for guiding water supply to the second storage area 101*b*.

A user who has seen the screen C3 may supply water to the second storage area 101*b*.

According to various embodiments, when the detergent supply device 100 includes a configuration capable of supplying water to the storage area 101, an element requesting water supply from the user on the screen C3 may be omitted.

In addition, according to various embodiments, the second user interface may include an indicator notifying that cleaning of the second storage area 101*b* is needed in order to change the use of the second storage area 101*b*.

The controller 200 may, in response to a user input to start cleaning of the second storage area 101*b* being received through the input interface 16*a* while the screen C3 is being output on the output interface 16*b*, start a cleaning process on the storage area 101.

The second user interface may include a screen C4 for guiding a cleaning progress of the second storage area 101*b*.

According to various embodiments, the first user interface and the second user interface may also be provided through the user device 3.

The controller 200 may receive a command to change the use of the second storage area 101*b* from the user device 3 through the communication module 16*c*, and change the use of the second storage area 101*b*.

However, the controller 200 may, in response to the command to change the use of the second storage area 101*b* from the user device 3 through the communication module 16*c*, provide a second user interface through the output interface 16*b*.

On the other hand, when the detergent supply device 100 includes a configuration capable of supplying water to the storage area 101 according to various embodiments, the controller 200 may, in response to a command to change the use of the storage area 101*b* from the user device 3 through the communication module 16*c*, proceed with a cleaning process on the second storage area 101*b*.

According to the disclosure, in a case that the use of the storage area 101 is changed, the operation proceeds with a cleaning of the storage area 101, so that detergent may be prevented from being stuck.

In addition, in a case that the use of the storage area 101 is changed, a user interface for requesting cleaning of the storage area 101 may be provided, so that user convenience may be promoted.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

In addition, the computer-readable storage medium may be provided in the form of a non-transitory storage medium. Here, when a storage medium is referred to as "non-transitory," it may be understood that the storage medium is tangible and does not include a signal, but rather that data is semi-permanently or temporarily stored in the storage medium. For example, a "non-temporary storage medium" may include a buffer in which data is temporarily stored.

According to an embodiment, the methods according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed through an application store (e.g., Play Store™) online. In the case of online distribution, at least a portion of the computer program product may be stored at least semi-permanently or may be temporarily generated in a storage medium, such as a memory of a server of a manufacturer, a server of an application store, or a relay server.

Although embodiments of the disclosure have been described with reference to the accompanying drawings, a person having ordinary skilled in the art will appreciate that other specific modifications may be easily made without departing from the technical spirit or essential features of the invention. Therefore, the foregoing embodiments should be regarded as illustrative rather than limiting in all aspects.

What is claimed is:

1. A washing machine comprising:
- a tub;
- a drum configured to be rotatable inside the tub;
- a detergent supply device configured to supply a detergent into the tub, the detergent supply device including:
  - a storage area;
  - a pump motor configured to pump a liquid in the storage area; and
  - a discharge port configured to guide the liquid pumped by the pump motor into the tub;
- a user interface configured to receive a user input to request a cleaning of the storage area; and
- a controller configured to:
  - detect a cleaning condition of the storage area based on a detected load of the pump motor; and
  - based on the user input being received and the detected cleaning condition, perform a cleaning process of the storage area.

2. The washing machine of claim 1, wherein the controller is configured to, based on the detecting of the cleaning condition of the storage area, control the user interface to notify a user that the storage area needs to be cleaned.

3. The washing machine of claim 1, wherein the controller is configured to drive the pump motor during a wash process or a rinse process, and detect the cleaning condition of the storage area based on a driving voltage value of the pump motor during the wash process or the rinse process.

4. The washing machine of claim 3, wherein the controller is configured to, in response to the driving voltage value of the pump motor being greater than or equal to a predetermined value, detect the cleaning condition of the storage area.

5. The washing machine of claim 3, wherein the storage area includes a first storage area and a second storage area, the pump motor includes;
- a first pump motor configured to pump a liquid accommodated in the first storage area; and
- a second pump motor configured to pump a liquid accommodated in the second storage area, and
- the controller is configured to drive the first pump motor during the wash process and drive the second pump motor during the rinse process.

6. The washing machine of claim 5, wherein the controller is configured to, in response to a driving voltage value of the first pump motor being greater than or equal to a predetermined value, detect a cleaning condition of the first storage area; and
- in response to a driving voltage value of the second pump motor being greater than or equal to a predetermined value, detect a cleaning condition of the second storage area.

7. The washing machine of claim 1, further comprising a sensor configured to detect the liquid accommodated in the storage area,
- wherein based on the detecting of the cleaning condition of the storage area, the controller is configured to, control the user interface to guide a user to input the user input in response to the liquid not being detected by the sensor.

8. The washing machine of claim 1, further comprising:
- a water supply device configured to supply external water into the tub;
- a drive motor configured to rotate the drum; and
- a drain device configured to drain water in the tub,
- wherein the controller is configured to control the pump motor, the water supply device, the drive motor, and the drain device to perform the cleaning process of the storage area.

9. The washing machine of claim 8, wherein the cleaning process of the storage area includes:
- a pump process to drive the pump motor;
- a water supply process to drive the water supply device;
- an agitation process to agitate the drum;
- a drain process to drive the drain device; and
- a spin-dry process to rotate the drum while driving the drain device.

10. The washing machine of claim 9, further comprising a sensor configured to detect a liquid accommodated in the storage area, wherein the controller is configured to, in response to a start of the cleaning process of the storage area, start the pump process, and based on the liquid not being detected by the sensor, end the pump process.

11. The washing machine of claim 10, wherein the controller is configured to perform each of the water supply process and the agitation process at least once before an ending of the pump process but after the start of the cleaning process to clean the storage area.

12. The washing machine of claim 11, wherein the controller is configured to, in response to the ending of the pump process, perform each of the water supply process, the drain process, and the spin-dry process at least once.

13. The washing machine of claim 9, wherein the storage area includes a first storage area and a second storage area, the pump motor includes a first pump motor configured to pump a liquid accommodated in the first storage area and a second pump motor configured to pump a liquid accommodated in the second storage area, the cleaning process of the storage area includes a first cleaning process to clean the first storage area, a second cleaning process to clean the second storage area, and a third cleaning process to clean both the first storage area and the second storage area, and the pump process includes a first pump process to drive the first pump motor, a second pump process to drive the second pump motor, and a third pump process to drive at least one of the first pump motor and the second pump motor.

14. The washing machine of claim 1, wherein the storage area includes a first storage area and a second storage area, the user interface is configured to:

provide a first user interface to set a use of the second storage area as a detergent compartment or a softener compartment; and provide a second user interface to request a cleaning of the second storage area in response to the use of the second storage area being changed through the first user interface.

15. The washing machine of claim 14, wherein the controller is configured to, upon receiving a user input to request the cleaning of the second storage area through the second user interface, perform a cleaning process to clean the second storage area.

16. The washing machine of claim 1, wherein the controller controls the user interface to notify a user by displaying a message indicating that the storage area needs to be cleaned.

17. The washing machine of claim 1, wherein the controller controls the user interface to notify a user by sounding a warning sound or outputting a text message as sound indicating that the storage area needs to be cleaned.

18. The washing machine of claim 7, wherein the controller is configured to the user interface to transmit a message to an external device to notify that the storage area needs to be cleaned.

* * * * *